US007913657B2

(12) United States Patent
Maehara et al.

(10) Patent No.: US 7,913,657 B2
(45) Date of Patent: Mar. 29, 2011

(54) VARIABLE VALVE TIMING MECHANISM

(75) Inventors: Hayato Maehara, Saitama (JP); Takaaki Tsukui, Saitama (JP); Toru Gunji, Saitama (JP); Shinji Saito, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 448 days.

(21) Appl. No.: 12/032,232

(22) Filed: Feb. 15, 2008

(65) Prior Publication Data

US 2008/0202460 A1 Aug. 28, 2008

(30) Foreign Application Priority Data

Feb. 23, 2007 (JP) ..... 2007-043938
Feb. 26, 2007 (JP) ..... 2007-044914
Mar. 2, 2007 (JP) ..... 2007-052244

(51) Int. Cl.
*F01L 1/34* (2006.01)

(52) U.S. Cl. ..... 123/90.16; 123/90.15; 74/567

(58) Field of Classification Search ..... 123/90.15, 123/90.16, 90.6; 74/567
See application file for complete search history.

(56) References Cited

FOREIGN PATENT DOCUMENTS

JP 63-1707 A 1/1988

*Primary Examiner* — Zelalem Eshete
(74) *Attorney, Agent, or Firm* — Birch, Stewart, Kolasch & Birch, LLP

(57) ABSTRACT

In a variable valve timing mechanism, a valve-lifting cam member is fitted, slidably in the circumferential direction, onto a camshaft that is driven to rotate in synchronization with a crankshaft of a four-stroke cycle internal combustion engine. An eccentric collar is set between a driving collar fixed on the camshaft and the valve-lifting cam member. A driving projection is formed in the driving collar and engages with one of sandwiching portions of the eccentric collar. A driven protrusion is formed in the valve-lifting cam member and engages with another one of the sandwiching portions of the eccentric collar. A linkage mechanism includes the eccentric collar, the drive, and the driven protrusions. The variable valve timing mechanism adjusts the timing of opening and closing of the valve while the rotational phase of the valve-lifting cam member is cyclically varied relative to the camshaft by the eccentricity of the eccentric collar.

19 Claims, 20 Drawing Sheets

VARIABLE VALVE TIMING MECHANISM

CROSS-REFERENCE TO RELATED APPLICATIONS

The present application claims priority under 35 USC 119 to Japanese Patent Application Nos. 2007-043938 filed on Feb. 23, 2007; 2007-044914 filed on Feb. 26, 2007 and 2007-052244 filed on Mar. 2, 2007 the entire contents thereof are hereby incorporated by reference.

BACKGROUND OF THE INVENTION

1. Field of the Invention

The present invention relates to a variable valve timing mechanism that varies the timing of the opening and closing the valves in a four-cycle internal combustion engine.

2. Description of Background Art

A variable valve timing mechanism has the following structure. An eccentric shaft that rotates independently from the rotation of a camshaft is disposed inside the camshaft. An eccentric collar having two sandwiching portions located on two sides across the center thereof is supported by the outer circumference of an eccentric portion of the eccentric shaft with rollers, as clearance-securing members, interposed in between. The eccentric collar thus supported is capable of rotating eccentrically. A driving collar having a driving projection that engages with a first one of the sandwiching portions of the eccentric collar is attached to the outer circumference of the camshaft and thus is integrated with the camshaft. A valve-lifting cam member having a driven projection that engages with a second one of the sandwiching portions of the eccentric collar is attached onto the outer circumference of the camshaft. The valve-lifting cam member thus attached is capable of sliding in the circumferential direction. The torque of the driving projection of the driving collar that rotates integrally with the camshaft is transmitted to the driven projection of the valve-lifting cam member via the pair of the sandwiching portions of the eccentric collar. The valve-lifting cam member is driven while the rotational phase thereof is cyclically varied. The eccentric shaft is provided to adjust and set the center position of the eccentric collar by use of the eccentric portion. See, for example, Japanese Unexamined Patent Application Laid-open Publication No. Sho63-1707 (FIG. 4 and FIG. 6)).

In a variable valve timing mechanism a pin is conventionally used to fix a driving collar onto a camshaft so as to rotate integrally with the camshaft. In the variable valve timing mechanism in which the pin is used, the pin has to be pressed to fit, so that the assembling operation of the driving collar to the camshaft and the maintenance operation that needs the detaching of the pin become complicated. In addition, a space for a pin hole has to be secured, so that the cylindrical portion of the driving collar becomes larger in size in the axial direction. As a consequence, the variable valve timing mechanism becomes larger in size. Moreover, forming the hole for this purpose needs a larger driving collar so as to secure a sufficient strength of the driving collar.

A conventional structure of eccentric shaft includes a shaft portion and an eccentric portion. The eccentric portion has a smaller diameter than that of the shaft portion, and has its center that is offset from the center of the shaft portion. When a large force is applied on a first one of the control driving portion of the eccentric shaft and the valve-lifting cam member, the large force is transmitted to a second one of the two members. The two members, thus, have to be made stronger. This leads to an increase in weight of the eccentric shaft.

In a conventional variable valve timing mechanism, the eccentric collar eccentrically rotates in a state where a plurality of rollers are disposed to secure a certain clearance between the eccentric collar and the outer circumference of the eccentric portion. The rollers are held respectively in the retaining windows formed in the camshaft. When the internal combustion engine runs normally, the eccentric portion of the eccentric shaft is stopped, the camshaft rotates, and the eccentric collar eccentrically rotates along with the rotation of the camshaft. Accordingly, the relative amount of rotation of the camshaft to the eccentric collar is small, while the relative amount of rotation of the camshaft to the eccentric portion of the eccentric shaft is large. Accordingly, each of the rollers does not actually roll, but slides on a particular portion thereof that is in contact with the eccentric portion of the eccentric shaft. In this particular portion, the convex surface of the roller is in contact with the convex surface of the eccentric portion, so that the surface pressure is high. As a consequence, securing the durability of these rollers is difficult.

SUMMARY AND OBJECTS OF THE INVENTION

An object of an embodiment of the present invention is to provide fixation means of a driving collar by which means the operations for assembling and disassembling of the driving collar are made easier. In addition, by the fixation means, a cylindrical portion of the driving collar is made more compact in size in the axial direction while a sufficient strength of the driving collar is secured.

According to an embodiment of the present invention, a variable valve timing mechanism, in which a valve-lifting cam member is fitted, slidably in the circumferential direction, onto a camshaft that is driven to rotate in synchronization with a crankshaft of a four-cycle internal combustion engine. In addition, in the variable valve timing mechanism an eccentric collar is set between a driving collar fixed on the camshaft and the valve-lifting cam member. A linkage mechanism includes the eccentric collar, a driving projection formed in the driving collar and engaging with one of sandwiching portions of the eccentric collar, and a driven projection formed in the valve-lifting cam member and engaging with another one of the sandwiching portions of the eccentric collar. With the linkage mechanism, the torque of the driving collar is transmitted to the valve-lifting cam member. The timing of the opening and closing of the valve is adjusted by making the rotational phase of the valve-lifting cam member to be cyclically varied relative to the camshaft by the eccentricity of the eccentric collar. The variable valve timing mechanism is characterized by a key provided between the camshaft and the driving collar and used to fix the driving collar onto the camshaft.

According to an embodiment of the present invention, the variable valve timing mechanism includes the driving collar that includes a cylindrical portion and the driving projection protruding from the cylindrical portion. The key is in a position partially overlapping the driving projection in the axial direction of the camshaft.

According to an embodiment of the present invention, the variable valve timing mechanism further includes a bearing for the camshaft disposed between two flanges provided on the camshaft. In the variable valve timing mechanism, the driving projection protrudes from one of the flanges to the opposite side of the flange from the side where the bearing is located.

According to an embodiment of the present invention, the variable valve timing mechanism includes the driving-projection sandwiching portion of the eccentric collar. The driven-projection sandwiching portions are disposed as being offset from each other in the axial direction so as to make each of the sandwiching portions closer to the corresponding one of the projections that engage with the sandwiching portion.

According to an embodiment of the present invention, the variable valve timing mechanism further includes clearance-securing members installed respectively in a plurality of retaining windows formed in the circumference of the camshaft. Each clearance-securing member is in contact with the outer circumferential surface of an eccentric portion of an eccentric shaft fitted to a central hole of the camshaft with the inner circumferential surface of the eccentric collar. Accordingly, a clearance is secured between the two surfaces. In the cross section of each clearance-securing member, each of the two side-end portions of the clearance-securing member, the portions being in contact with the corresponding retaining window, is formed by a part of an outer circumferential circle. The central portion of the clearance-securing member is formed by a section that is in contact with the outer circumference of the eccentric portion and with the inner circumference of the eccentric collar.

According to an embodiment of the present invention, fixing the driving collar to the camshaft with the key allows an easy operation in assembling the driving collars to the other members and an easy maintenance operation that requires the detaching of the driving collars. In addition, no space for holes is required. Thus, the driving collar can be made smaller in size. Moreover, no holes are actually formed in the circumference of the driving collar, so that the strength can be secured easily. This contributes further to an even more compact construction of the driving collar. Furthermore, the variable valve timing mechanism as a whole can also be made more compact in size.

According to an embodiment of the present invention, the driving collar is composed of the cylindrical portion and the driving projection that protrudes from the cylindrical portion. The key is in a position partially overlapping the driving projection. Accordingly, the driving collar can be made compact in size in the axial direction.

According to an embodiment of the present invention, in each of the camshafts, the bearing has a simpler structure. In addition, the driving projection is formed in the flange. Accordingly, no driving collar is needed in this portion, so that the variable valve timing mechanism can be made more compact in size in the axial direction. In addition, a reduction in the number of component parts can be accomplished.

According to an embodiment of the present invention, the driving-projection sandwiching portion and the driven-projection sandwiching portion are disposed as being offset from each other in the axial direction so that the sandwiching portions are made closer to the respective projections that engage with the corresponding sandwiching portions. This allows the drive projections and the driven protrusion to be made shorter in dimension. As a result the variable valve timing mechanism can be made lighter in weight.

According to an embodiment of the present invention, though a columnar clearance-securing member makes the clearance-securing member to be in contact with the eccentric portion of the eccentric shaft with a convex surface being against another convex surface, a sectorial clearance-securing member allows the clearance-securing member to be in contact with the eccentric portion of the eccentric shaft with a convex surface being against a concave surface. Accordingly, the surface pressure between the outer surface of the eccentric portion of the eccentric shaft and each of the clearance-securing members is reduced, so that each of the clearance-securing members can be made more compact in size in the axial direction of the clearance-securing member.

An object of an embodiment of the present invention is to provide a lighter eccentric shaft. To this end, a large force that is applied on a first one of the control driving portion (gear train and servo motor) and the valve-lifting cam portion has to be prevented from transmitting to a second one of the two members, and an appropriate strength has to be set for each member.

According to an embodiment of the present invention, a variable valve timing mechanism is provided with the following features. In the variable valve timing mechanism, an eccentric shaft having an eccentric portion is inserted into a central hole of a camshaft that is driven to rotate in synchronization with a crankshaft of a four-cycle internal combustion engine. The eccentric shaft is thus made capable of rotating relative to the camshaft. A valve-lifting cam member is fitted, slidably in the circumferential direction, onto the outer circumference of the camshaft. An eccentric collar that is made eccentric in accordance with the position of the center of the eccentric portion is set between a driving collar fixed on the camshaft and the valve-lifting cam member. A linkage mechanism is composed of the eccentric collar, a driving protrusion formed in the driving collar and engaging with one of sandwiching portions of the eccentric collar, and a driven protrusion formed in the valve-lifting cam member and engaging with another one of the sandwiching portions of the eccentric collar. With the linkage mechanism, the torque of the driving collar is transmitted to the valve-lifting cam member. The timing of opening and closing the valve is adjusted by making the rotational phase of the valve-lifting cam member be cyclically varied relative to the camshaft by the eccentricity of the eccentric collar. The variable valve timing mechanism includes a breakable portion breakable by an occurrence of an abnormally excessive input and formed in the eccentric shaft between the eccentric portion and a power-for-control inputting portion.

According to an embodiment of the present invention, the variable valve timing mechanism further includes an oil passage for supplying oil to lubricate components, such as cams, formed inside the eccentric shaft in the axial direction. The breakable portion that is breakable by an occurrence of an abnormally excessive input is formed outside of a section where the oil passage exists.

According to an embodiment of the present invention, the variable valve timing mechanism includes the breakable portion that is breakable by an occurrence of an abnormally excessive input and has a shape having at least two parallel faces formed by cutting away portions of a shaft portion of the eccentric shaft. The breakable portion is formed as being exposed out of the camshaft.

According to an embodiment of the present invention, the variable valve timing mechanism includes the breakable portion that is breakable by an occurrence of an abnormally excessive input has a polygonal cross-sectional shape.

According to an embodiment of the present invention, the variable valve timing mechanism includes the breakable portion that is breakable by an occurrence of an abnormally excessive input is formed at an end of the eccentric shaft.

According to an embodiment of the present invention, when an especially large force is applied on either the valve-lifting cam portion or the control driving portion of the eccentric shaft of the engine that is running, the breakable portion that can be broken by an occurrence of an abnormally excessive input is broken to protect the component parts. Accordingly, the component parts have to have less strength, thereby preventing the increase in weight. The breakable portion that can be broken by a large force is formed not in the camshaft but in the eccentric shaft. Accordingly, even with the breaking of the breakable portion, the drive of the camshaft and that of the cam continue over the breakage of the breakable portion just like before the breakage. In this case, the variable valve timing mechanism is reduced to a simple valve timing mechanism without any function that will give a name of "variable" to the mechanism. The internal combustion engine continues to run over the loss of the above-mentioned function.

According to an embodiment of the present invention, the breakable portion that can be broken by an occurrence of an abnormally excessive input is formed outside of the section where the oil passage exists. Accordingly, the breakage of the breakable portion does not damage the oil passage.

According to an embodiment of the present invention, the faces formed by cutting away parts of the eccentric shaft are used as a guide for the initial setting of the eccentric shaft, and the tools can be used by taking advantage of these faces at the assembling.

According to an embodiment of the present invention, the breakable portion is made thinner, and thereby the eccentric shaft can be made still lighter in weight.

According to an embodiment of the present invention, the assembling of the driven gear for inputting the power for control to the eccentric shaft can be done easily by use of the breakable portion that can be broken by an occurrence of an abnormally excessive input. Particularly, in the case of the breakable portion with the two parallel faces, the dimensional accuracy can be managed easily, and there is less looseness between the gear and the eccentric shaft. As a result, an accurate control can be accomplished.

An object of an embodiment of the present invention is providing a variable valve timing valve-lifting system equipped with clearance-securing members which can replace the rollers and which can lower the surface pressure in the contacting portion.

According to an embodiment of the present invention, a variable valve timing valve-lifting system includes a camshaft having a central hole and rotating in synchronization with rotations of a crankshaft, an eccentric shaft having an eccentric portion and being inserted into the central hole of the camshaft, a driving collar fixed onto the camshaft and rotating together with the camshaft, an eccentric collar rotating, in response to the rotation of the driving collar, on a rotating center that is offset from a rotating center of the camshaft, the eccentric portion of the eccentric shaft, the eccentric portion positioned on the inner circumferential side of the eccentric collar and changing the position of the rotating center of the eccentric collar when the eccentric shaft moves rotationally. A valve-lifting cam member is provided rotating in response to the rotation of the eccentric collar with a plurality of retaining windows formed in a part, located between the eccentric collar and the eccentric portion, of the camshaft, and formed so as to allow the communication between an eccentric-collar side and an eccentric-portion side to be accomplished therethrough. Clearance-securing members are disposed respectively in the retaining windows, each clearance-securing member being in contact both with the eccentric collar and with the eccentric portion, thereby securing clearance between the eccentric collar and the eccentric portion. Here, the clearance-securing members are sliding spacers. In each of the sliding spacers, an inner-side and an outer-side contact surfaces are formed by curved lines that are considered, substantially, to be parts of concentric circles when viewed in the axial direction of the camshaft. The sliding spacers slide both on the eccentric collar and on the eccentric portion.

According to an embodiment of the present invention, the variable valve timing valve-lifting system as recited in the first aspect with the following additional features. When viewed in the axial direction of the camshaft, the curvature radius of a sliding surface of the sliding spacer on the eccentric-collar side is larger than the radius of an inner-side surface of the eccentric collar, and the curvature radius of the sliding surface of the sliding spacer on a side facing the eccentric-portion of the eccentric shaft is larger than the radius of an outer-side surface of the eccentric portion.

According to an embodiment of the present invention, the variable valve timing valve-lifting system as recited in the first aspect with the following additional features. When viewed in the axial direction of the camshaft, the curvature radius of a sliding surface of the sliding spacer on the eccentric-collar side is smaller than the radius of an inner-side surface of the eccentric collar, and the curvature radius of the sliding surface of the sliding spacer on a side facing the eccentric portion of the eccentric shaft is smaller than the radius of an outer-side surface of the eccentric portion. In addition, a curved surface is formed in the edge portion of a sliding contact portion of the sliding spacer with an outer circumference of the eccentric portion.

According to an embodiment of the present invention, the variable valve timing valve-lifting system as recited in any of the second and third aspects with the following additional features. When viewed in the axial direction of the camshaft, the sliding surface of the sliding spacer on the eccentric-collar side and the sliding surface of the sliding spacer on the eccentric-portion side are formed by parts of concentric circles.

According to an embodiment of the present invention, the variable valve timing valve-lifting system as recited in any of the first and fourth aspects with the following additional features. An inner-side surface of the retaining window, which surface is in contact with a side surface of the sliding spacer, is formed to be flat. In addition, the side surface of the sliding spacer, which side surface is in contact with the inner-side surface of the retaining window, is formed to be in an arc when viewed in the axial direction of the camshaft.

According to an embodiment of the present invention, in comparison with a roller, the sliding spacer of this form has a large sliding area between the sliding spacer and the eccentric collar as well as between the sliding spacer and the eccentric portion of the eccentric shaft. Accordingly, the surface pressure is lowered while the durability is improved.

According to an embodiment of the present invention, each sliding spacer thus formed slides on three points in total, two outside and one inside. This renders the sliding surfaces stabilized. In addition, the rotation amount of the eccentric collar relative to the sliding spacer is small so that the sliding by line-contact at end portions of the sliding spacer causes no problems at all. Moreover, the rotation amount of the eccentric portion of the eccentric shaft relative to the sliding spacer is large, but the angle formed by the tangential line of the eccentric portion and the tangential line of the sliding spacer is extremely small in the vicinity of each contact surface. Accordingly, the surface pressure can be lowered and favorable lubrication can be achieved.

According to an embodiment of the present invention, each sliding spacer thus formed slides on three points in total—one outside and two inside. This renders the sliding surfaces stabilized.

In addition, the rotation amount of the eccentric collar relative to the sliding spacer is small, so that the eccentric collar is in contact with the sliding spacer at one point. Meanwhile, the rotation amount of the eccentric portion of the eccentric shaft relative to the sliding spacer is large, so that the eccentric portion of the eccentric shaft is in contact with the sliding spacer at two points, thereby reducing the surface pressure of the sliding surface. In addition, forming the edge portion of the slidingly contact portion with a curved surface allows favorable lubrication to be achieved.

According to an embodiment of the present invention, when viewed in the axial direction of the camshaft, the inner and the outer sliding surfaces of the sliding spacer with this form are formed by parts of concentric circles. Accordingly, the sliding spacer can be fabricated by cutting a hollow pipe and then scraping a part thereof. This leads to a higher productivity.

According to an embodiment of the present invention, when the eccentric portion of the eccentric shaft is located at a certain position, the sliding spacer slides within the retaining window in the radial direction. In such a situation, an improvement in operation is achieved. In addition, the side surface of the sliding spacer is formed to be in an arc when viewed in the axial direction of the camshaft. Accordingly, when the position of the eccentric portion of the eccentric shaft in the circumferential direction thereof differs, the sliding surface also differs. In such a situation, uniform sliding characteristics can be accomplished.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 9(*b*) is a view showing an outside appearance the clearance-securing member; and FIG. 9(*c*) is a side elevational view of the clearance-securing member.

DETAILED DESCRIPTION OF THE PREFERRED EMBODIMENTS

Figure 1:
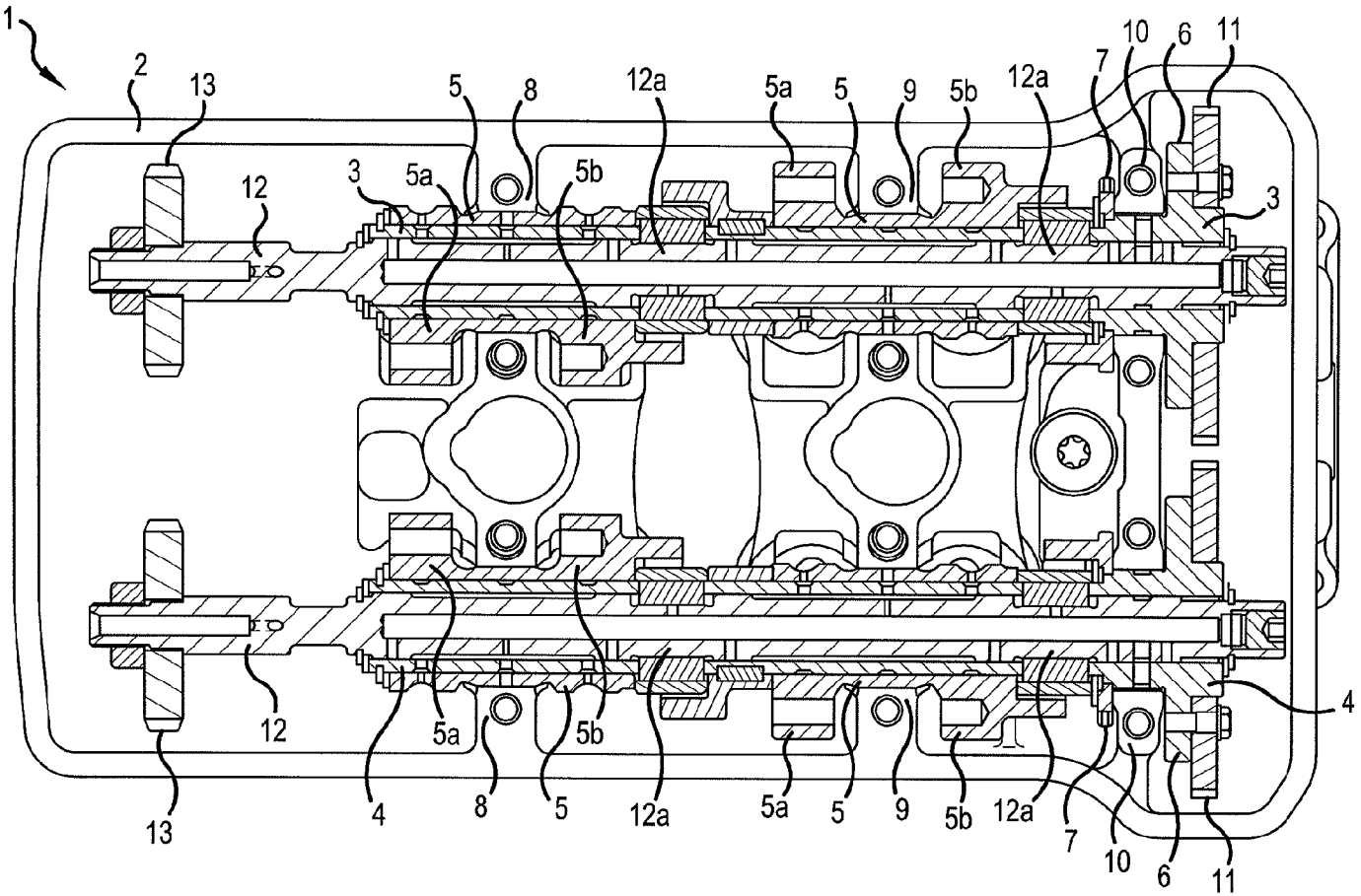
FIG. 1 is a plan view showing a cylinder head of a four-cycle two-cylinder internal combustion engine according to a first embodiment of the present invention, wherein the shown cylinder head is cut by a plane including the center line of each of camshafts.

FIG. 1 is a plan view showing a cylinder head 2 of a four-cycle two-cylinder internal combustion engine 1 according to a first embodiment of the present invention. The shown cylinder head 2 is cut by a plane including the center line of each of camshafts 3 and 4. The camshaft 3 for the inlet system and the camshaft 4 for the exhaust system are disposed in parallel with each other on the top surface of the cylinder head 2. Each of the cylinders has two inlet valves and two exhaust valves. In the camshaft 3 for the inlet system, two identical valve-lifting cam members 5, 5 are provided to open and close the inlet valves of each cylinder, and are arranged along the camshaft 3. Each of the two valve-lifting cam members 5, 5 has two cam lobes 5*a* and 5*b*. Likewise, onto the camshaft 4 for the exhaust system, two valve-lifting cam members 5, 5 that are identical to the above-mentioned valve-lifting cam members 5, 5 are attached to open and close the exhaust valves of each cylinder. Each of these two valve-lifting cam members 5, 5 also has two cam lobes 5*a* and 5*b*.

Two flanges 6 and 7 are formed at an end of each of the camshafts 3 and 4. Each of the outer flanges 6 is integrally formed with the corresponding one of the camshafts 3 and 4. Meanwhile, each of the inner flanges is separately formed from the corresponding one of the camshafts 3 and 4, but is integrated with the camshaft by being pressed to fit onto the camshaft. Each of the camshafts 3 and 4 is rotatably supported by bearings 8, 9, and 10. The bearings 8 and 9 are respectively provided to the two valve-lifting cam members.

Each of the bearings 8 and 9 is disposed between the two cam lobes 5*a* and 5*b* formed in each of the two valve-lifting cam members, which are fitted and thus attached onto each of the camshafts 3 and 4. The bearing 10 is disposed between the two above-mentioned flanges 6 and 7.

Each of the outer flanges 6 provided at an end of each of the camshafts 3 and 4 has one of two driven sprocket 11, 11. A timing belt is looped around the driven sprockets 11, 11 and a drive sprocket provided on the crankshaft (not illustrated), and, with the timing belt, the camshafts 3 and 4 are driven to rotate by the crankshaft at a half revolving speed of the crankshaft.

The camshafts 3 and 4 are hollow and cylindrical. Into the central hole of each of the camshafts 3 and 4, one of eccentric shafts 12, 12 is inserted, and thus is made rotatable relative to the corresponding one of the camshafts 3 and 4. Each of the eccentric shafts 12, 12 has two identical eccentric portions 12*a*, 12*a*. One of identical driven gears 13 for control is attached onto and thus integrated with an end of each of the eccentric shafts 12, 12. The driven gears 13, 13 for control are driven and controlled by a control unit via a gear train and a servo motor (not illustrated). The driven gears 13, 13 for control thus controlled moves the central position of each eccentric portion 12*a* of each eccentric shaft 12 rotationally to a position such as to meet a predetermined purpose. At the steady driving, the eccentric shaft is stopped and the camshaft is rotating around the eccentric shaft.

Figure 2:
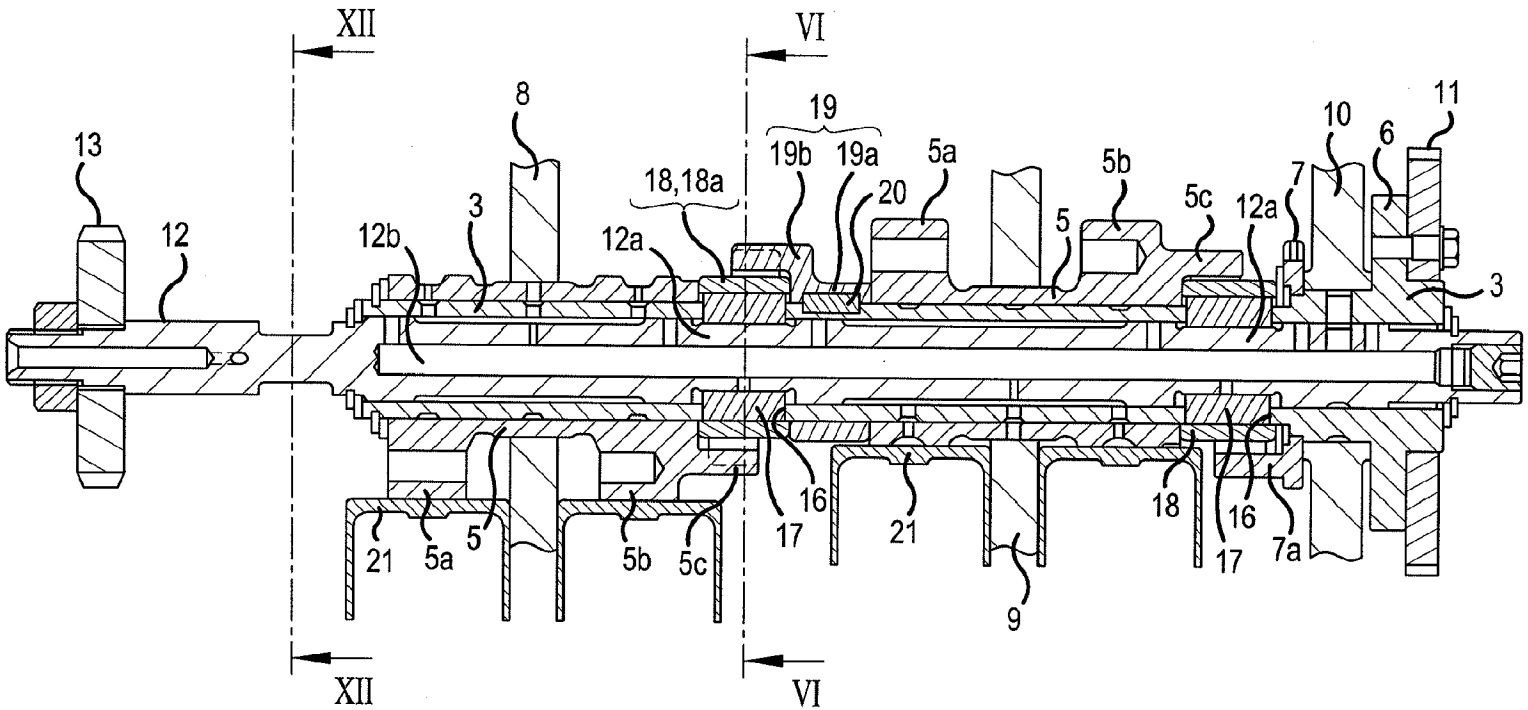
FIG. 2 is a longitudinal cross-sectional view of the camshaft.

FIG. 2 is a longitudinal cross-sectional view of the camshaft 3 for the inlet system. The following description is based on the camshaft 3 for the inlet system taken as an example of the two camshafts 3 and 4 for the inlet and exhaust systems, which have substantially identical structures to each other. In the description that follows, the "camshaft for the inlet system" is simply called the "camshaft" while the "inlet valve" is simply called the "valve."

In the camshaft 3, five rectangular retaining windows 16 are formed as arranged in the circumferential direction at each of the positions located at outer side of and corresponding to the two eccentric portions 12*a* and 12*a* of the eccentric shaft 12. A roller 17 is disposed and held inside each of the retaining windows 16 so as to be in contact with the outer circumferential surface of the eccentric portion 12*a*. Each of eccentric collars 18, 18 is attached at the outer side of each group of rollers. Here, each roller 17 is in contact with the inner surface of a cylindrical portion 18*a* of each of the eccentric collars 18, 18 while the rollers 17 are allowed to move in the circumferential direction relative to the cylindrical portion 18*a*.

A driving collar 19 is fitted onto the outer circumference of the camshaft 3, and is adjacent to one of the two eccentric collars 18, 18. The one that is adjacent to the driving collar 19 is located farther from the inner flange 7 than the other one is. The driving collar 19 is fixed to the camshaft 3 with a key 20, and thus is capable of rotating together with the camshaft 3. A driving projection 19*b* is formed integrally with a cylindrical portion 19*a*, and protrudes from the outer circumference of an end portion of the cylindrical portion 19*a* of the driving collar 19 towards the eccentric collar 18. The other eccentric collar 18 is adjacent to the inner flange 7. A driving projection 7*a* is formed integrally with the inner flange 7 and protrudes from the outer circumferential portion of the inner flange 7 towards the eccentric collar 18.

The valve-lifting cam members 5, 5 are provided at positions that are respectively adjacent to the eccentric collars 18, 18. Each of driven protrusions 5*c*, 5*c* is formed integrally with the corresponding one of the cam lobes 5*b*, 5*b* adjacent to the respective eccentric collars 18, 18. Each driven protrusion protrudes from an end face of each of the cam lobes 5*b*, 5*b* to the eccentric collar 18. FIG. 2 shows four valve top portions 21 that are brought into contact with the cam lobes 5*a* and 5*b*. An oil passage 12*b* is formed in the center portion of the eccentric shaft 12 to supply lubricating oil to various portions of the cam, the bearings, and the like.

Figure 3:
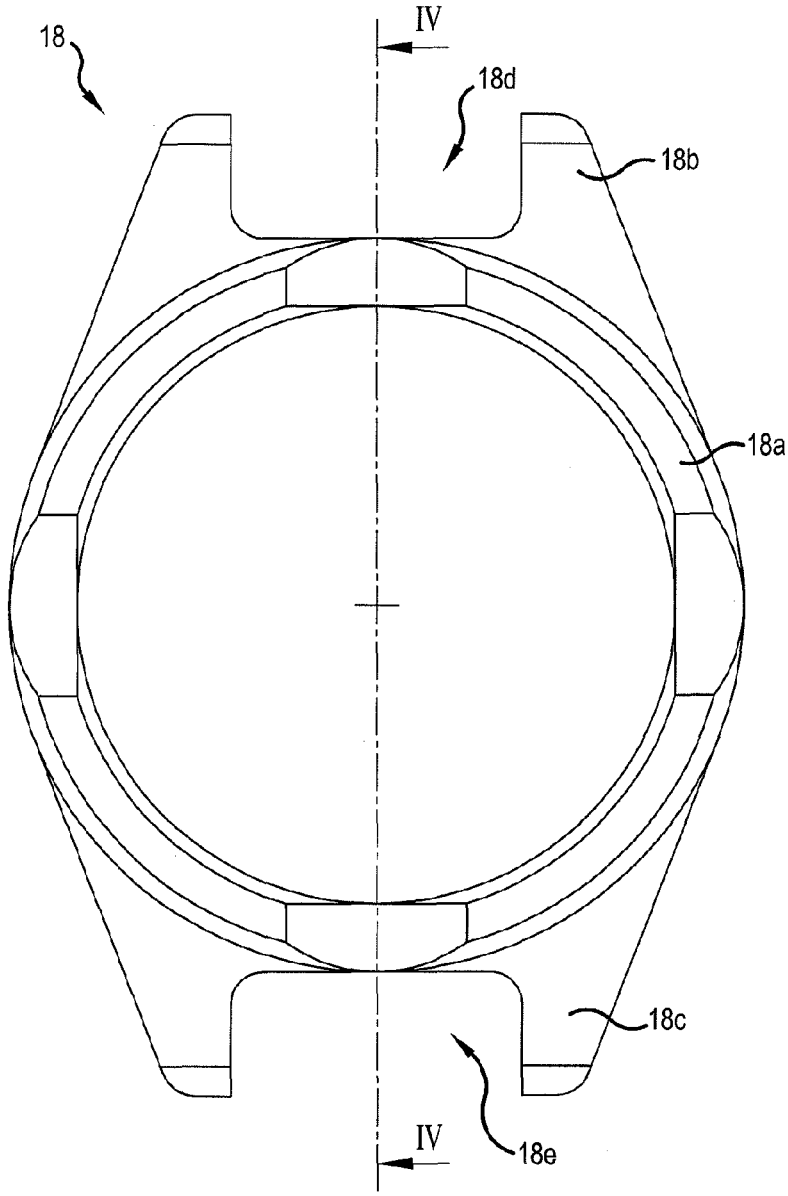
FIG. 3 is an enlarged view of an eccentric collar viewed from the axial direction.
Figure 4:
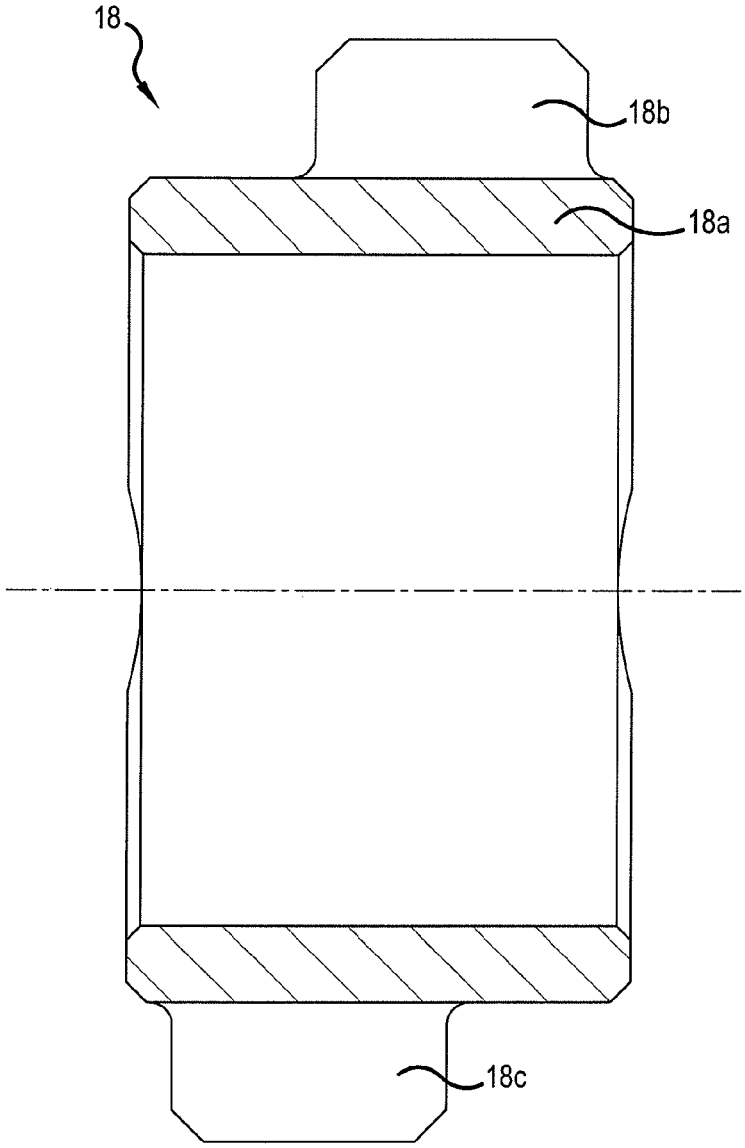
FIG. 4 is a cross-sectional view taken along the line IV-IV in FIG. 3.

FIG. 3 is an enlarged view of the eccentric collar 18 that is viewed from the axial direction. FIG. 4 is a cross-sectional view taken along the line IV-IV of FIG. 3. The eccentric collar 18 includes the cylindrical portion 18*a*, a pair of protrusion sandwiching portions, a drive-projection sandwiching portion 18*b* and a driven-projection sandwiching portion 18*c*, which are provided with the center of the cylindrical portion 18*a* disposed in between. In each of the sandwiching portions, grooves 18*d* and 18*e* are formed.

In FIG. 4, the sandwiching portions 18*b* and 18*c* are formed as being offset from each other to the shaft-end side. To put it other way, as FIG. 2 shows, the drive-projection sandwiching portion 18*b* is provided so as to get closer to the drive protrusion 19*b* or 7*a* while the driven-projection sandwiching portion 18*b* is provided to get closer to the driven protrusion 5*c*. This is because such provision makes the drive protrusions 19*b* and 7*a* as well as the driven protrusion 5*c* shorter in dimension. Accordingly, the bending stress acting on each protrusion can be made smaller.

FIG. 4 is a cross-sectional view of the eccentric collar 18 taken along the axis thereof. The eccentric collar 18 includes a cylindrical portion 18*a*, a pair or protrusion sandwiching portions—a drive-protrusion sandwiching portion 18*b* and a driven-protrusion sandwiching portion 18*c* which are provided with the center of the cylindrical portion 18*a* disposed in between.

In FIG. 2, a driving collar 19 is fitted onto the outer circumference of the camshaft 3, and is adjacent to one of the two eccentric collars 18, 18. The one that is adjacent to the driving collar 19 is located farther from the inner flange 7 than the other one is. The driving collar 19 is fixed to the camshaft 3 with a key 20, and thus is capable of rotating together with the camshaft 3. A driving protrusion 19*b* is formed integrally with a cylindrical portion 19*a*, and protrudes from the outer circumference of an end portion of the cylindrical portion 19*a* of the driving collar 19 towards the eccentric collar 18. The other eccentric collar 18 is adjacent to the inner flange 7. A driving protrusion 7*a* is formed integrally with the inner flange 7 and protrudes from the outer circumferential portion of the inner flange 7 towards the eccentric collar 18.

In FIG. 2, the valve-lifting cam members 5, 5 are provided at positions that are respectively adjacent to the eccentric collars 18, 18. Each of driven protrusions 5*c*, 5*c* is formed integrally with the corresponding one of the cam lobes 5*b*, 5*b* adjacent to the respective eccentric collars 18, 18. Each driven protrusion protrudes from an end face of each of the cam lobes 5*b*, 5*b* to the eccentric collar 18. FIG. 2 shows four valve top portions 21 that are brought into contact with the cam lobes 5*a* and 5*b*.

Figure 5:
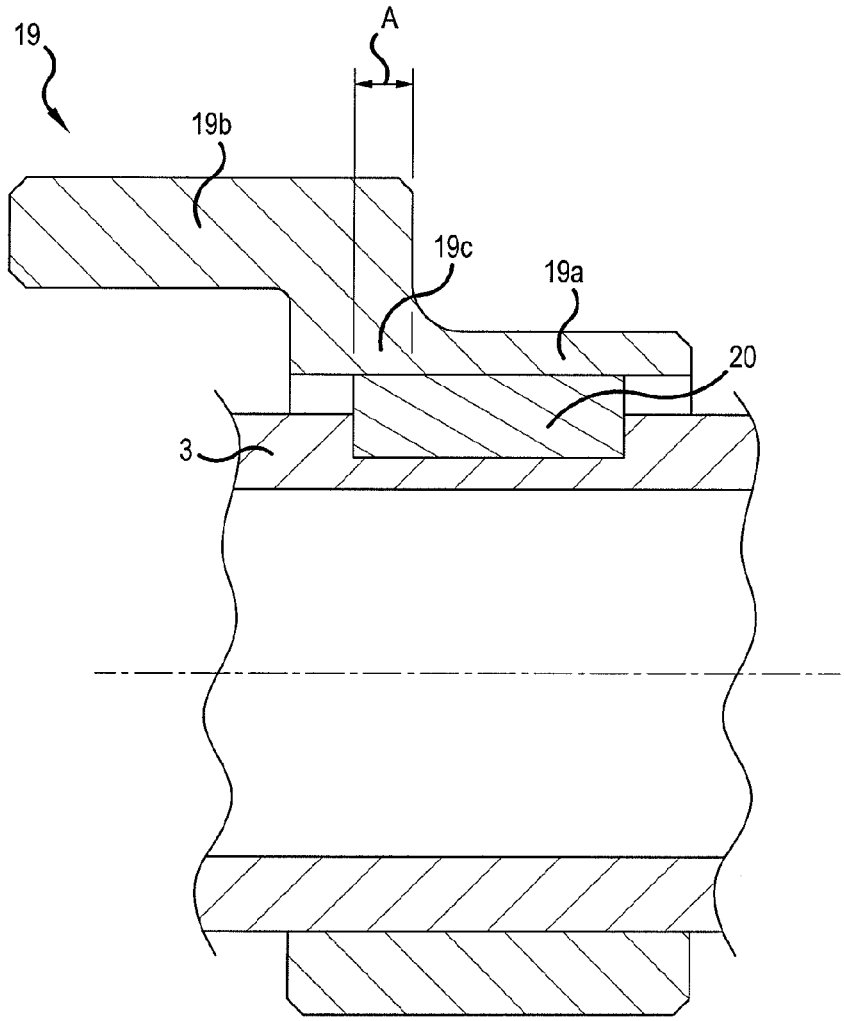
FIG. 5 is a cross-sectional view of a driving collar taken along the axis thereof.

FIG. 5 is a cross-sectional view of the driving collar 19 taken along the axis thereof, and shows a state in which the driving collar is fixed to the camshaft 3 with the key 20 so as to rotate integrally with the camshaft 3. The driving collar 19 includes the cylindrical portion 19*a* and the driving projection 19*b*, which is formed integrally with the cylindrical portion 19*a*, and protrudes from the outer circumference of an end portion, on the eccentric-collar 18 side, of a cylindrical portion 19*a* towards the eccentric collar 18. The key 20 is provided so as to partially overlap the driving projection 19*b* (the overlapping portion is indicated by reference numeral A in the drawing). With this structure, the key 20 can receive the moment that acts on a base portion 19*c* of the driving projection 19*b*. Consequently, the cylindrical portion 19*a* can be made in a smaller thickness. In addition, while enough contact area between the key 20 and the driving collar 19 is secured to transmit the torque of the camshaft 3 from the key 20 to the driving collar 19, the cylindrical portion 19*a* of the driving collar 19 can be made compact in the axial direction.

Figure 6:
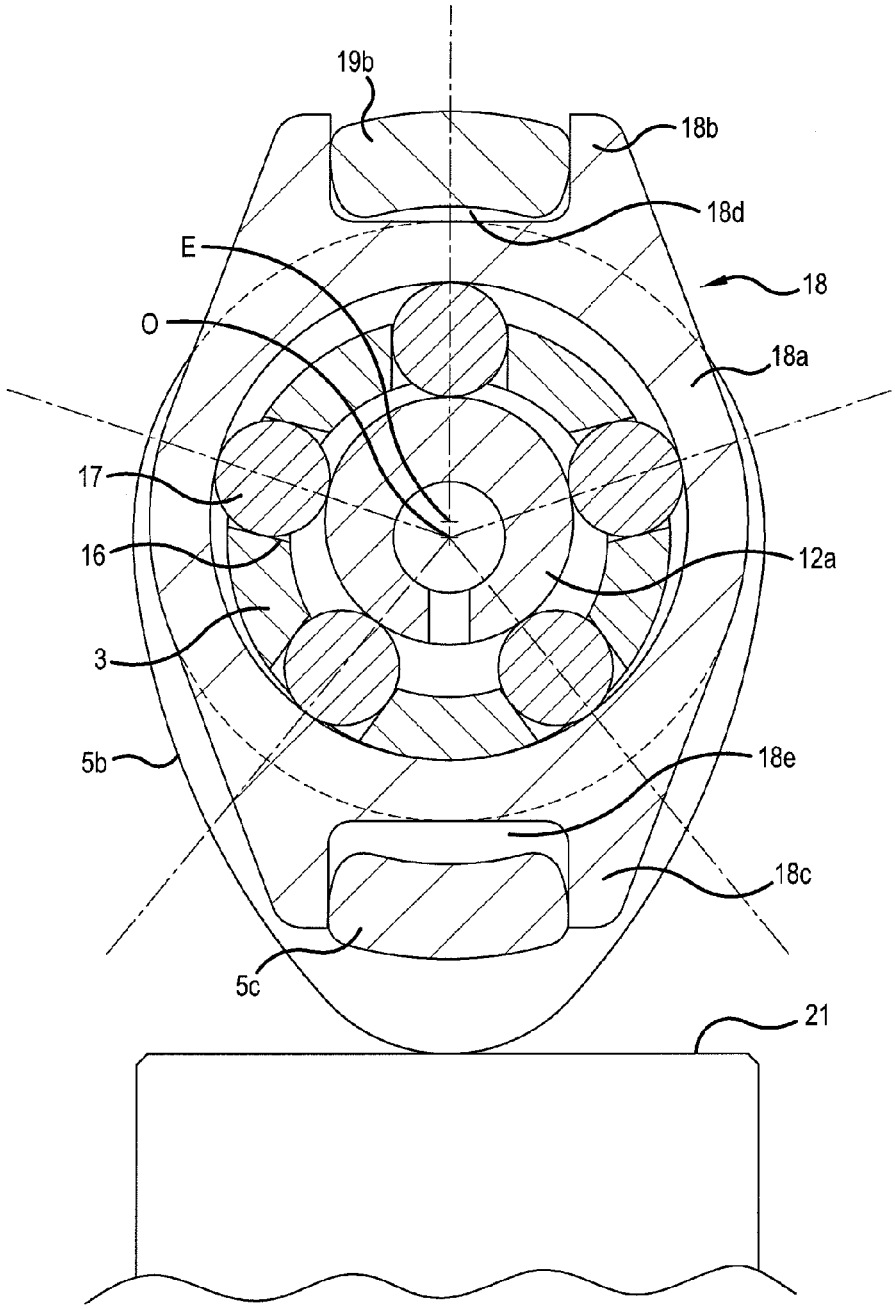
FIG. 6 is a cross-sectional view of a central portion of the eccentric collar taken along the line VI-VI in FIG. 2 and showing a low-speed state.

FIG. 6 is a cross-sectional view of a central portion of the eccentric collar 18 taken along the line VI-VI in FIG. 2, and shows a low-speed state. In the drawing, reference numeral O denotes the center of the camshaft 3 while reference numeral E denotes the center of the eccentric portion 12*a* of the eccentric shaft 12. The inner surface of the cylindrical portion 18*a* of the eccentric collar 18 is supported by the plural rollers 17 at a uniform distance from the outer circumference of the eccentric portion 12*a*. Accordingly, the center of the eccentric collar 18 is aligned with the center E of the eccentric portion 12*a* of the eccentric collar 12. The rollers 17 serve as the clearance-securing members to keep a constant clearance between the outer circumference of the eccentric portion 12*a* and the inner circumference of the cylindrical portion 18*a* of the eccentric collar 18. In the eccentric collar 18, the driving-projection sandwiching portion 18*b* and the driven-projection sandwiching portion 18*c* are formed integrally the eccentric collar 18 at positions that are symmetrical with respect to the center of the eccentric collar 18. The holding grooves 18*d* and 18*e* of the sandwiching portions hold the driving projection 19*b* and the driven protrusion 5*c* respectively. In the case of the eccentric collar 18 that is closer to the inner flange 7, what engages with the sandwiching groove 18*d* is not the driving projection 19*b* of the driving collar 19 but the driving projection 7*a* protruding from the inner flange 7.

With the above-described structure according to this embodiment, the following effects can be obtained. In the case of a low-revolution state of the internal combustion engine 1, by a controlling signal from the control unit, the eccentric portion 12*a* of the eccentric shaft 12 is turned and kept at a position farthest away from the valve top portion 21. FIG. 6 shows such a state. In addition, in accordance with a principle that is similar to the principle described in Japanese Unexamined Patent Application Laid-open Publication Sho63-1707, the timing of the starting of the opening of the valve is retarded and the timing of the closing of the valve is advanced. Accordingly, a retarded opening-start timing of the inlet valve and an advanced closing timing of the exhaust valve render the valve overlapping period shorter.

Figure 7:
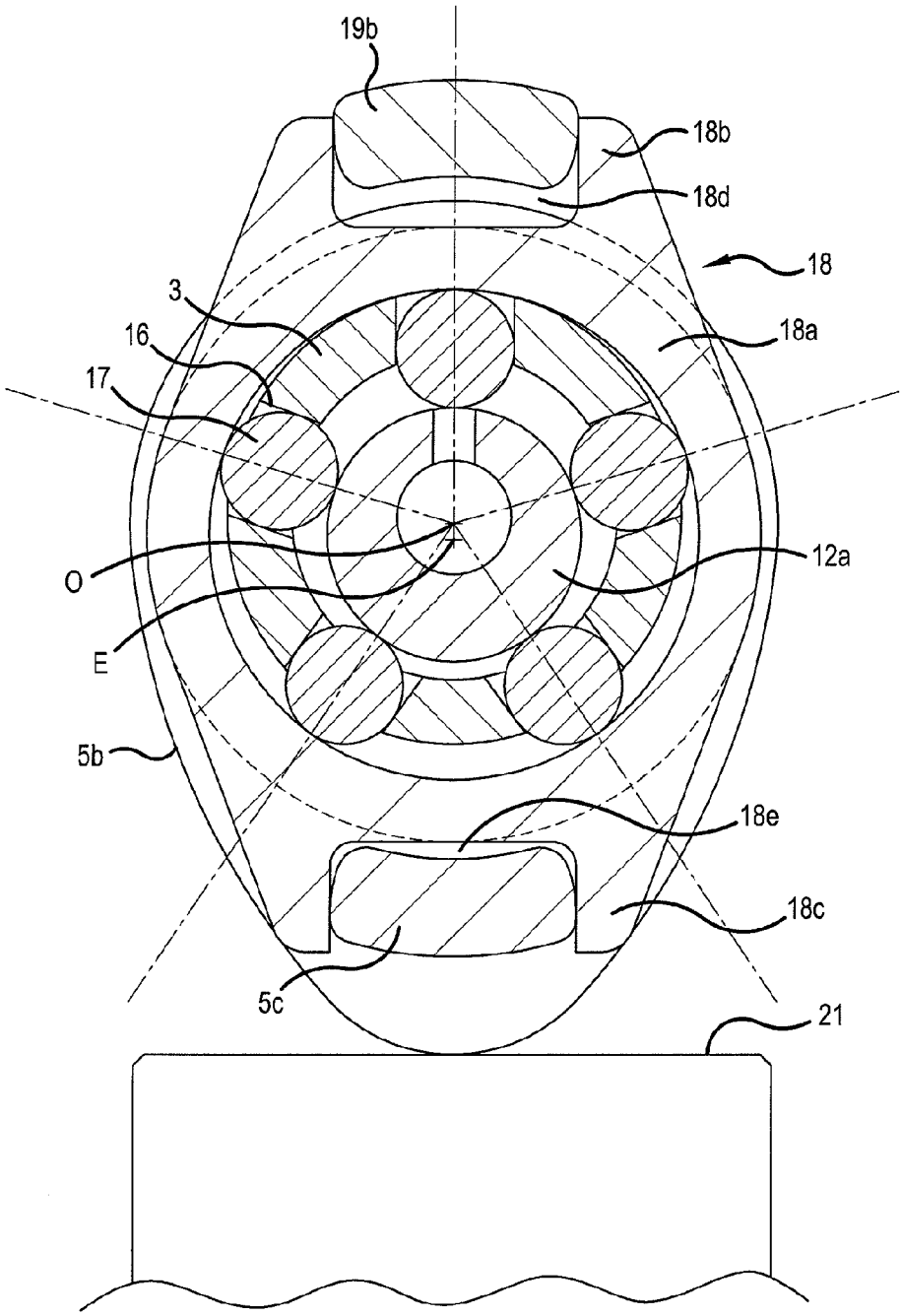
FIG. 7 is a cross-sectional view of the same position that is shown in FIG. 6, but showing a high-speed state.

FIG. 7 is a cross-sectional view of the same position that is shown in FIG. 6, but showing a high-speed state. When the revolution of the internal combustion engine 1 is increased up to the maximum revolution, the eccentric portion 12*a* of the eccentric shaft 12 is turned and kept at a position closest to the valve top portion 21. FIG. 7 shows such a state. In addition, in accordance with a principle that is similar to the principle described above, the timing of the starting of the opening of the valve is advanced and the timing of the closing of the valve is retarded. Accordingly, an advanced opening-start timing of the inlet valve and a retarded closing timing of the exhaust valve render the valve overlapping period longer. As a result, a state suitable for the high-speed running performance is achieved.

In FIG. 2, an oil passage 12*b* is formed in the center portion of the eccentric shaft 12 to supply lubricating oil to various portions of the cam, the bearings, and the like. A breakable portion 12*c* is formed near the end portion of the eccentric shaft 12. The smaller diameter of the breakable portion 12*c* than that of the eccentric portion 12*a* allows the breakable portion 12*c* to be broken by an occurrence of an abnormally excessive input. The breakable portion 12*c* is formed between the eccentric portion 12*a* and the position of the driven gear 13 for control where the driving power for controlling the eccentric shaft is inputted. Within the section, the breakable portion 12*c* has the smallest cross-sectional area, so that the breakable portion 12*c* is the weakest against the torsion moment. The breakable portion 12*c* is formed at the outer side of the section where the oil passage is formed. More specifically, the part of the shaft portion of the eccentric shaft 12, in which part the breakable portion 12*c* is formed, is the portion sticking out of the camshaft 3 and exposed to the outside.

Figure 8:
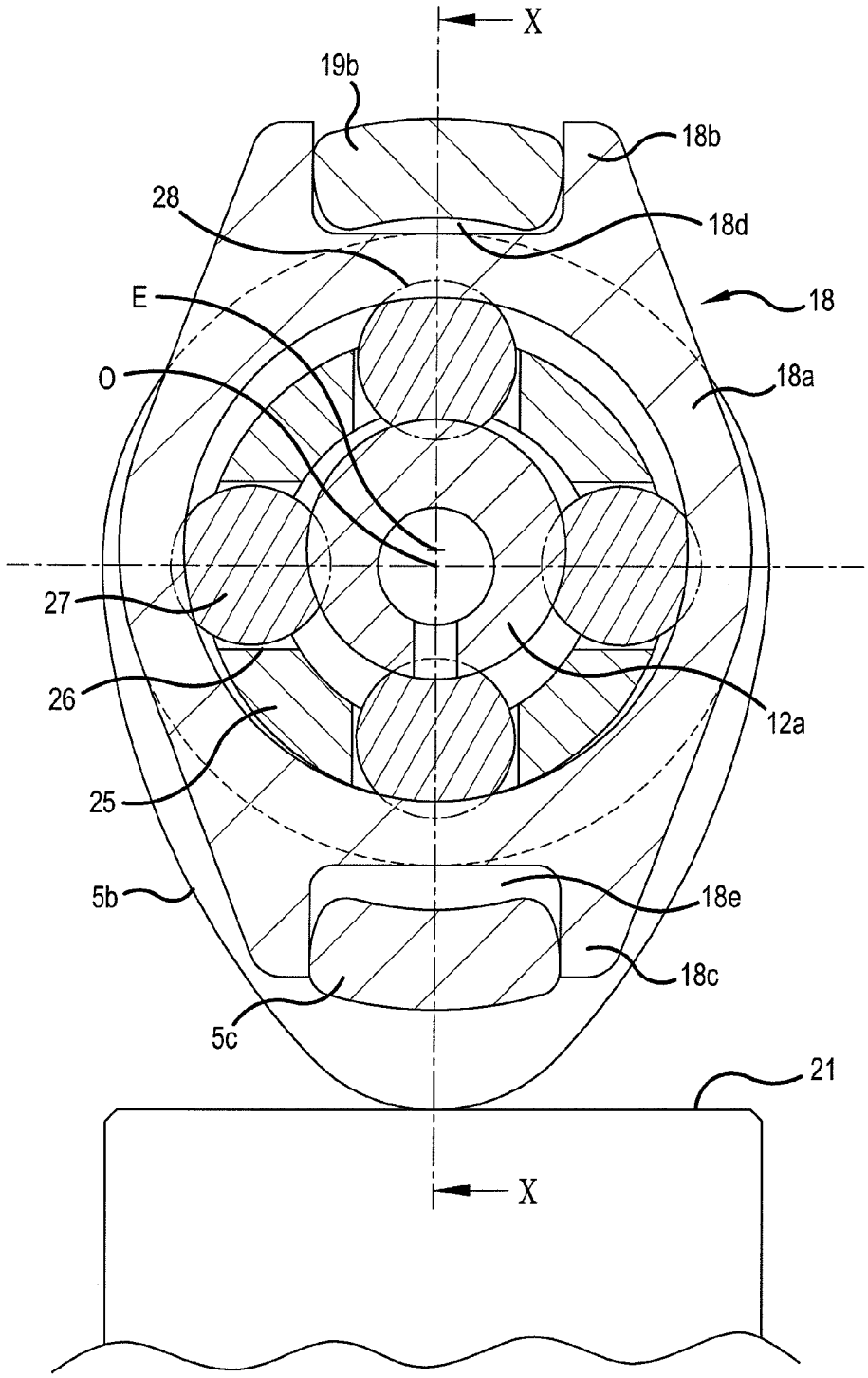
FIG. 8 is a cross-sectional view of a central portion of an eccentric collar according to a second embodiment of the present invention.

FIG. 8 is a cross-sectional view of a central portion of an eccentric collar of a variable valve timing mechanism according to a second embodiment of the present invention. FIG. 8 shows a low-speed running state. This embodiment differs from the first embodiment in a camshaft 25, retaining windows 26, and clearance-securing members 27. The rest of the components shown in FIG. 8, an eccentric portion 12*a* of an eccentric shaft 12, an eccentric collar 18 and each of the components thereof, a driving projection 19*b*, a cam lobe 5*b*, a driven protrusion 5*c*, a valve top portion 21, is the same as in the first embodiment, so that the same reference numerals are used. As illustrated in FIG. 8, O and E denote respectively the centers of the camshaft 25 and of the eccentric portion 12*a*.

Each of the clearance-securing members 27 of this embodiment has a sectorial cross section. In the cross section, each of the two side portions are formed by a part of an outer circumferential circle 28 while the central portion is formed by a part of a sector that is in contact with the outer circumference of the eccentric portion 12*a* and with the inner circumference of the eccentric collar 18. Each of the clearance-securing members 27 is cut out from a single pipe material with a part thereof being gouged off and thus the outer circumference circle of the clearance-securing member 27 has a larger diameter than the diameter of the roller of the first embodiment. For this reason, each of the retaining windows 26 formed in the camshaft 25 has a larger width than that of the first embodiment, and a reduced number of the clearance-securing members 27 are formed.

Each clearance-securing member 27 of the above-described structure has its inner surface in contact with the outer surface of the eccentric portion 12*a* and its outer surface in contact with the inner surface of the eccentric collar 18. The above-described use of the clearance-securing members 27, each with the sectorial cross section, reduces the surface pressure on the inner surface of the clearance-securing members 27 from the corresponding surface pressure in the case of the columnar clearance-securing members. As a consequence, each of the clearance-securing members 27 has a shorter dimension and the member can be made more compact in size.

Figure 9A:
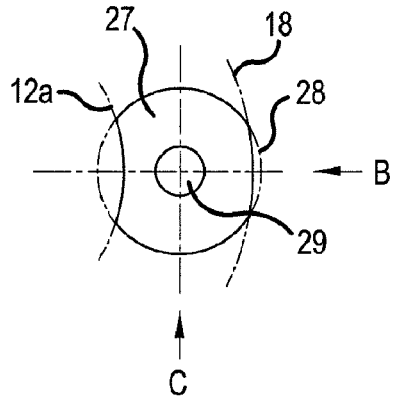
FIG. 9(*a*) is an end-face view of the clearance-securing member.
Figure 9B:
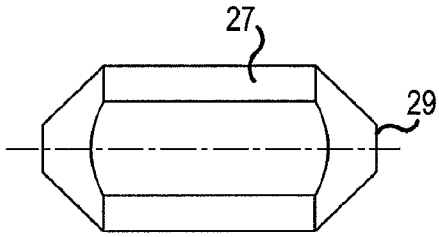
Figure 9C:
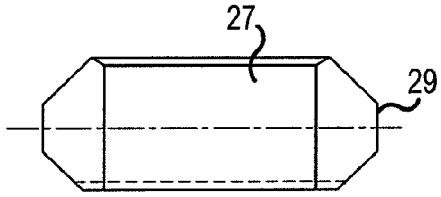

FIGS. 9(*a*) to 9(*c*) is a three-side view of the clearance-securing member 27. FIG. 9(*a*) is an end-face view, FIG. 9(*b*) is a view showing an outside appearance thereof (a diagram viewed as indicated by the arrow B in FIG. 9(*a*)), and FIG. 9(*c*) is a side elevational view (a diagram viewed as indicated by the arrow C in FIG. 9(*a*)). The cross section of the clearance-securing member 27 has each of the two side portions formed by a part of the outer circumferential circle 28. Meanwhile, the inner and the outer sides of the cross section of the clearance-securing member 27 are made to be in contact respectively with the outer circumference of the eccentric portion 12*a* and with the inner circumference of the eccentric collar 18. In addition, each of the end portions of each clearance-securing member 27 is cut, as shown in FIGS. 9(*b*) and 9(*c*) to be made into the shape of a circular truncated cone. Each of end faces 29 is thus formed in a circle with a smaller diameter.

Figure 10:
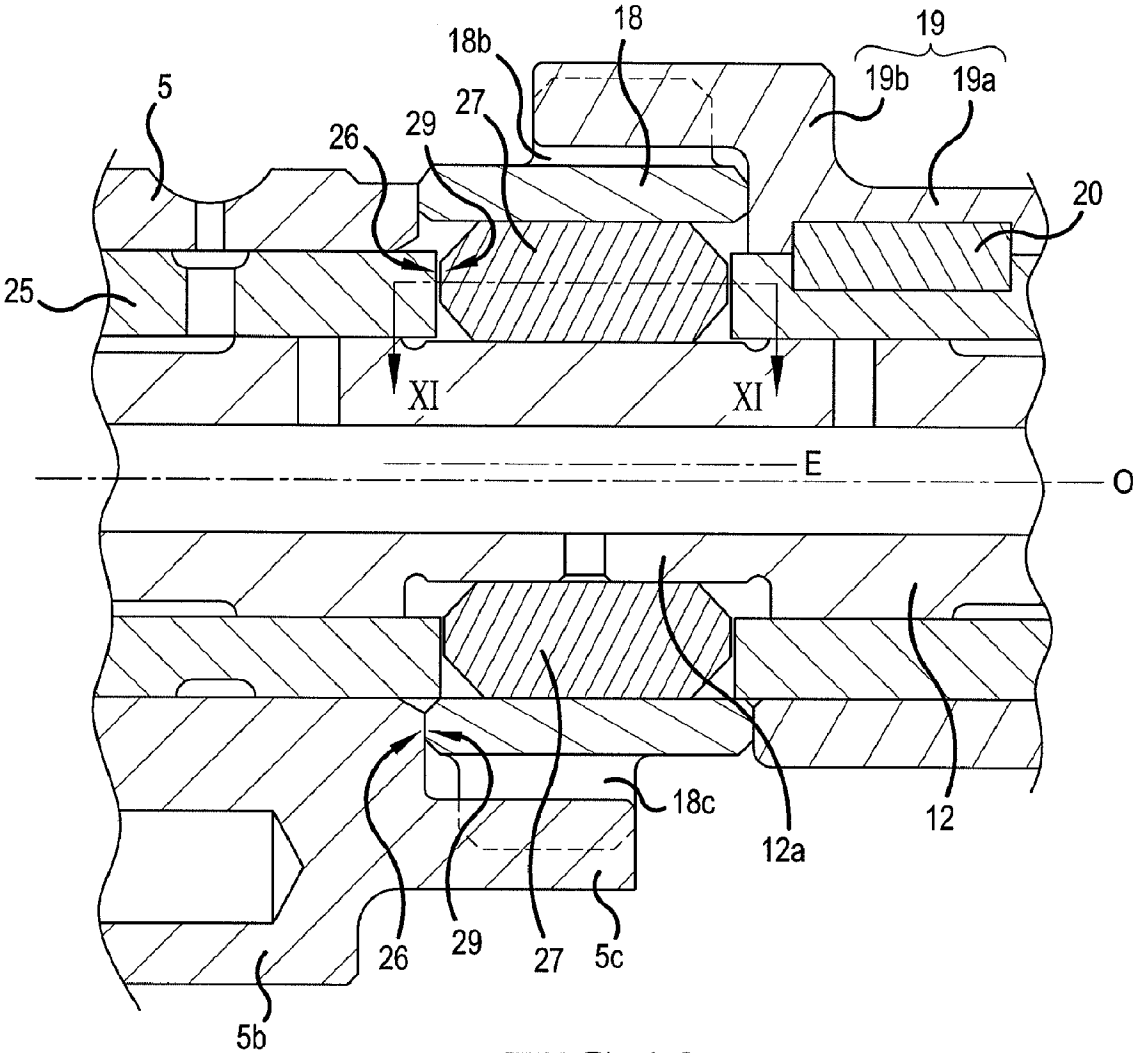
FIG. 10 is a cross-sectional view taken along the line X-X in FIG. 8.
Figure 11:
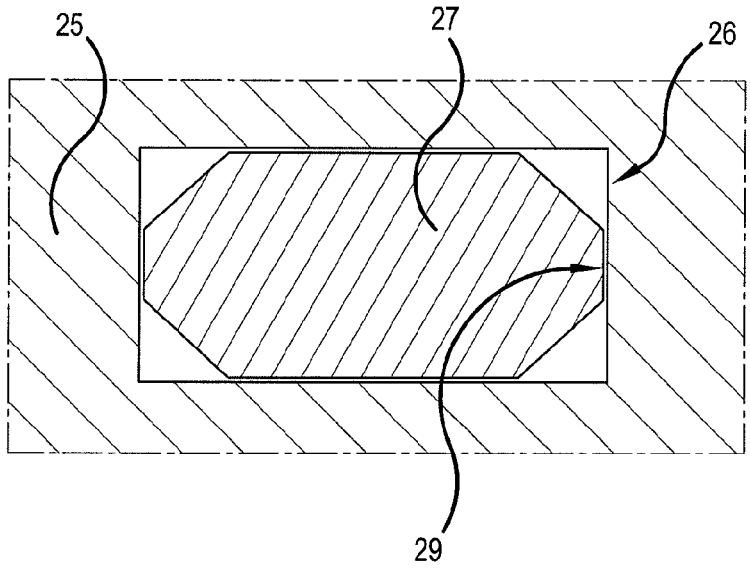
FIG. 11 is a cross-sectional view taken along the line XI-XI in FIG. 10.

FIG. 10 is a cross-sectional view taken along the line X-X in FIG. 8. FIG. 11 is a cross-sectional view taken along the line XI-XI in FIG. 10. The cutting of the end portions of each clearance-securing member 27 into the shape of a circular truncated cone makes the end portion have a smaller contact area with the inner surface of each end portion of the retaining window 26. As a result, the friction in this part of the mechanism can be reduced.

The embodiments that have been described in detail will have the following effects.

Fixing the driving collar 19 to the camshaft 3 with the key 20 allows an easy operation in assembling the driving collars to the other members and an easy maintenance operation that requires the detaching of the driving collar 19. In addition, no space for holes is required, and thus the driving collar 19 can be made smaller in size. Moreover, no holes are actually formed in the circumference of the driving collar 19, so that the strength can be secured easily. This contributes further to an even more compact construction of the driving collar 19. Furthermore, the variable valve timing mechanism as a whole can also be made more compact in size.

The driving collar 19 is composed of the cylindrical portion 19*a* and the driving projection 19*b*, and is fixed onto the camshaft 3 with the key 20. The key 20 is disposed as partially overlapping the driving projection 19*b* in the axial direction of the shaft. With this structure, the key 20 can receive the moment acting on the base portion 19*c* of the driving projection 19*b*. Consequently the cylindrical portion 19*a* can be made in a smaller thickness. In addition, while an enough contact area between the key 20 and the driving collar 19 is secured to transmit the torque of the camshaft 3 from the key 20 to the driving collar 19, the cylindrical portion 19*a* of the driving collar 19 can be made compact in the axial direction.

In each of the camshafts 3 and 4, the bearing 10 is disposed between the two flanges 6 and 7 that are provided on each of the camshafts 3 and 4. Accordingly, the positioning of the bearing 10 in the axial direction of the corresponding camshaft is done by the help of the two flanges sandwiching the bearing 10. Such a way of positioning needs a simpler structure for positioning than in the case where grooves for fitting to the flanges provided onto the camshaft are formed in the bearing for the purpose of positioning in the axial direction of the camshaft. In addition, the driving projection 7*a* protrudes from the inner flange 7 to the opposite side of the inner flange 7 from the side where the bearing 10 is located. Accordingly, no independent driving collar is needed in this portion, so that the variable valve timing mechanism can be made more compact in size in the axial direction. In addition, the reduction in the number of component parts can be accomplished.

The driving-projection sandwiching portion 18*b* and the driven-projection sandwiching portion 18*c* are disposed as being offset from each other in the axial direction onto the eccentric collar 18 so that the driving-projection sandwiching portion 18*b* is made to get closer to the driving projection 19*b* and 7*a*, and that the driven-projection sandwiching portion 18*c* is made to get closer to the driven protrusion 5*c*. Such provision makes the drive protrusions 19*b* and 7*a* as well as the driven protrusion 5*c* shorter in dimension. As a result the variable valve timing mechanism can be made lighter in weight.

In the second embodiment, each of the two side portions of the cross section of the clearance-securing member 27 is formed by a part of the outer circumferential circle, while the central portion is formed by a part of a section that is in contact with the outer circumference of the eccentric portion and with the inner circumference of the eccentric collar. Accordingly, the surface pressure between the outer surface of the eccentric portion of the eccentric shaft and each of the clearance-securing members is reduced from the corresponding surface pressure in the case of the columnar clearance-securing members, so that each of the clearance-securing members can be made more compact in size in the axial direction of the clearance-securing member. In addition, each of the end portions of each clearance-securing member 27 is cut to be made into the shape of a circular truncated cone. Such cutting of the end portion makes the end portion have a smaller contact area with the inner surface of each end portion of the retaining window 26. As a result, the friction in this part of the mechanism can be reduced.

Figure 12:
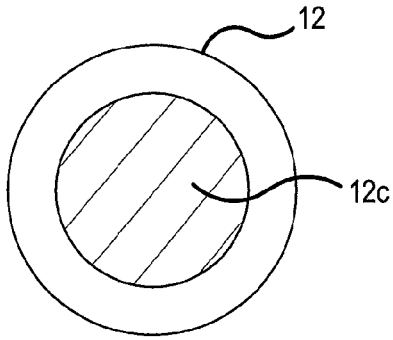
FIG. 12 is a cross-sectional view taken along the line XII-XII in FIG. 2 and showing an example of a breakable portion which has a circular cross section and which can be broken by an occurrence of an abnormally excessive input.

FIG. 12 is an enlarged cross-sectional view taken along the line XII-XII in FIG. 2, and shows a cross section of the breakable portion 12*c* which has a circular cross section and can be broken by an occurrence of an abnormally excessive input. The breakable portion 12*c* is thus formed in the eccentric shaft. Accordingly, when a large force is applied on a first one of the valve-lifting cam portion and the control driving portion of the eccentric shaft, the breakable portion is broken before the large force is transmitted to the second one of the two portions. Consequently, each one of the two component parts can be protected from the other, each of the two members can be formed with a modest strength, and thus, the increase in the weight of each member can be reduced. The role of the breakable portion is exactly the same that a fuse in an electrical apparatus plays. The formation of the breakable portion 12*c* outside the section where the oil passage 12*b* is formed prevents oil from leaking out even when the breakable portion is actually broken. Accordingly, the breaking of the breakable portion will never negatively affect the supplying of oil to the various parts of the apparatus. The drive of the camshaft and that of the cam continue over the breakage of the breakable portion just like before the breakage. In this case, the variable valve timing mechanism is reduced to a simple valve timing mechanism without any function that will give a name of "variable" to the mechanism. The internal combustion engine continues to run over the loss of the above-mentioned function.

Figure 13:
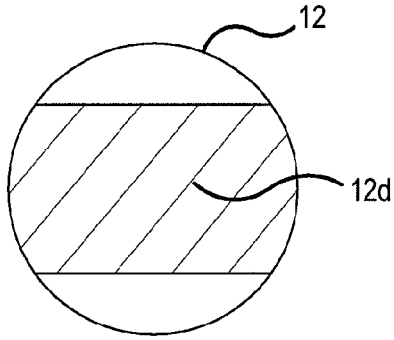
FIG. 13 is a cross-sectional view of the same position that is shown in FIG. 12, but showing an example of a breakable portion with a cross section having two parallel faces.

FIG. 13 is a second example of the cross-sectional shapes of the breakable portion that can be broken by an occurrence of an abnormally excessive input. The cross section shown in FIG. 13 is of the same position that the cross section of FIG. 12 is taken at. Shown in this example is a breakable portion 12*d* that has two side faces being in parallel with each other. To form such a shape, the surface of the eccentric shaft 12 is cut out at two positions. A part of the shaft portion of the eccentric shaft 12 is exposed to the outside from the end of the camshaft, and the faces formed by cutting out portions of the eccentric shaft 12 are located in this part of the shaft portion. Accordingly, the faces are used as a guide for the initial setting of the eccentric shaft. In addition, tools can be used at the assembling by taking advantage of these faces.

Figure 14:
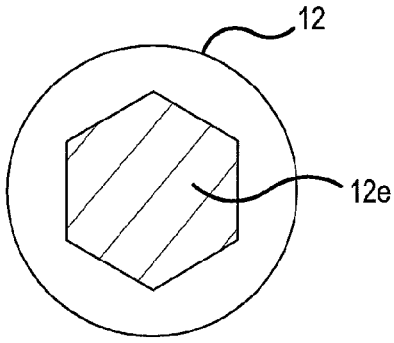
FIG. 14 is a cross-sectional view of of the same position that is shown in FIG. 12, but showing an example of a polygonal cross section.

FIG. 14 shows a third example of the cross-sectional shapes of the breakable portion that can be broken by an occurrence of an abnormally excessive input. The cross section shown in FIG. 14 is of the same position that the cross section of FIG. 12 is taken at. This is an example of a breakable portion 12*e* of a hexagonal cross-section, which represents polygonal cross-sections. The breakable portion 12*e* is made thinner so that the eccentric shaft can be made still lighter in weight.

Figure 15:
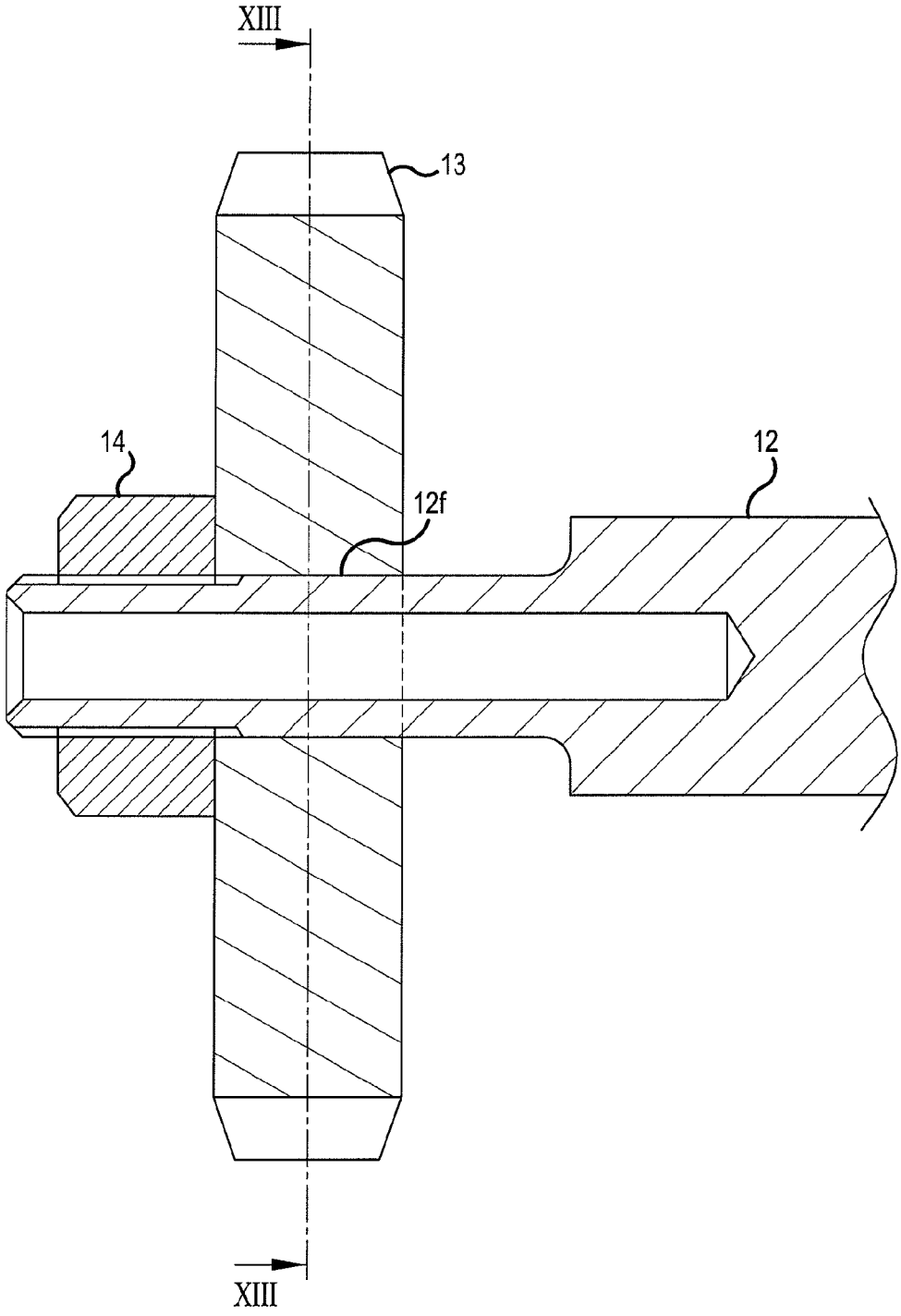
FIG. 15 is a vertical cross sectional view of an example where a gear where the power for control is inputted is coupled onto the breakable portion with two parallel faces formed at an end portion of the eccentric shaft.
Figure 16:
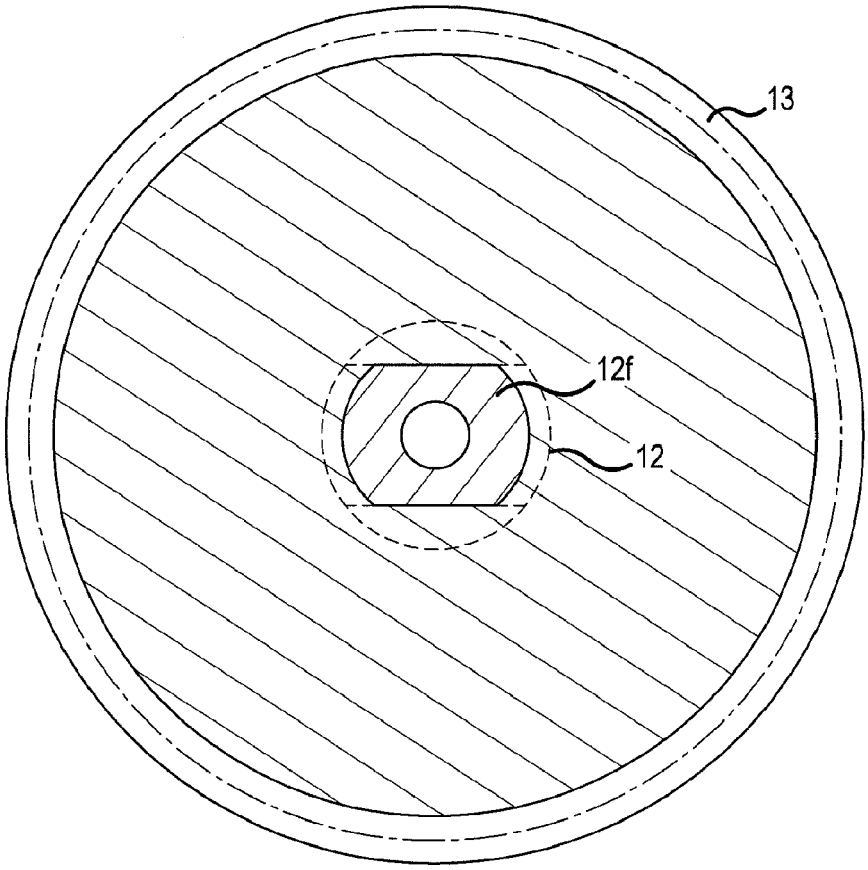
FIG. 16 is a cross-sectional view taken along the line XIII-XIII in FIG. 15.
Figure 17A:
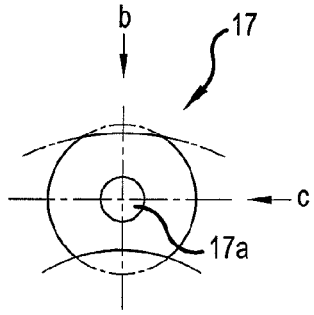
FIGS. 17(*a*) to 17(*d*) are four-side views of a sliding spacer 17.
Figure 17B:
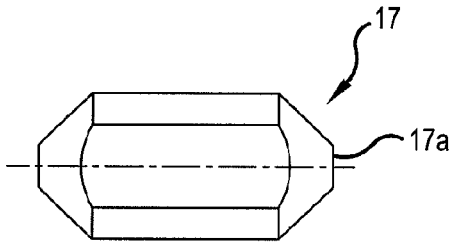
Figure 17C:
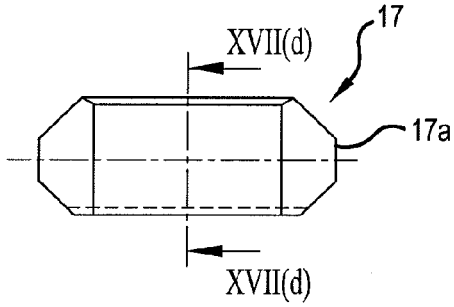
Figure 17D:
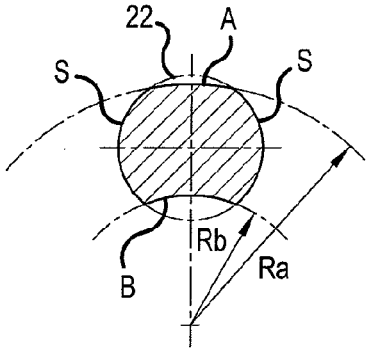

FIG. 15 is a vertical cross-sectional view of an example where a breakable portion 12*f* with two parallel faces formed at an end portion of the eccentric shaft. In the example, the driven gear 13 for control where the power for control is inputted is coupled onto the breakable portion 12*f* by taking advantage of this breakable portion and is fastened with a nut 14. FIG. 16 is a cross-sectional view taken along the line XIII-XIII in FIG. 15. An easy assembling of the driven gear 13 for control onto the eccentric shaft is accomplished by using the breakable portion that can be broken by an occurrence of an abnormally excessive input. More particularly, in the case of the breakable portion with the two parallel faces, the dimensional accuracy can be managed easily, and there is less looseness between the gear and the eccentric shaft. As a result, an accurate control can be accomplished.

The embodiments that have been described in detail will have the following effects.

The breakable portion which has a smaller diameter than the eccentric portion and which can be broken by an occurrence of an abnormally excessive input is formed in the eccentric shaft between the eccentric portion 12*a* and the power-for-control input portion (the position of the driven gear 13 for control). Accordingly, when an especially large force is applied on either the valve-lifting cam portion or the control driving portion (gear train and servo motor) of the eccentric shaft of the engine that is running, the breakable portion is broken to protect the component parts. Accordingly, the component parts have to have less strength, thereby preventing the increase in weight.

The oil passage for supplying oil to lubricate the component parts, such as the cams, is formed inside the eccentric shaft in the axial direction. Meanwhile, the breakable portion that can be broken by an occurrence of an abnormally excessive input is formed outside of the section where the oil passage exists. Accordingly, the breakage of the breakable portion does not damage the oil passage.

The breakable portion that can be broken by an occurrence of an abnormally excessive input has a shape with at least two parallel faces that are formed by cutting away parts of the shaft portion of the eccentric shaft. In addition, the breakable portion is formed as being exposed out of the camshaft. In this case, the faces formed by cutting away are used as a guide for the initial setting of the eccentric shaft, and the tools can be used by taking advantage of these faces at the assembling.

When the breakable portion that can be broken by an occurrence of an abnormally excessive input has a polygonal shape, the breakable portion is made thinner. Thereby, the eccentric shaft can be made still lighter in weight.

When the breakable portion that can be broken by an occurrence of an abnormally excessive input is formed at an end of the eccentric shaft, the assembling of the driven gear for control to the eccentric shaft can be done easily by use of the breakable portion. Particularly, in the case of the breakable portion with two parallel faces, the dimensional accuracy can be managed easily, and there is less looseness between the gear and the eccentric shaft. As a result, an accurate control can be accomplished.

Figure 21:
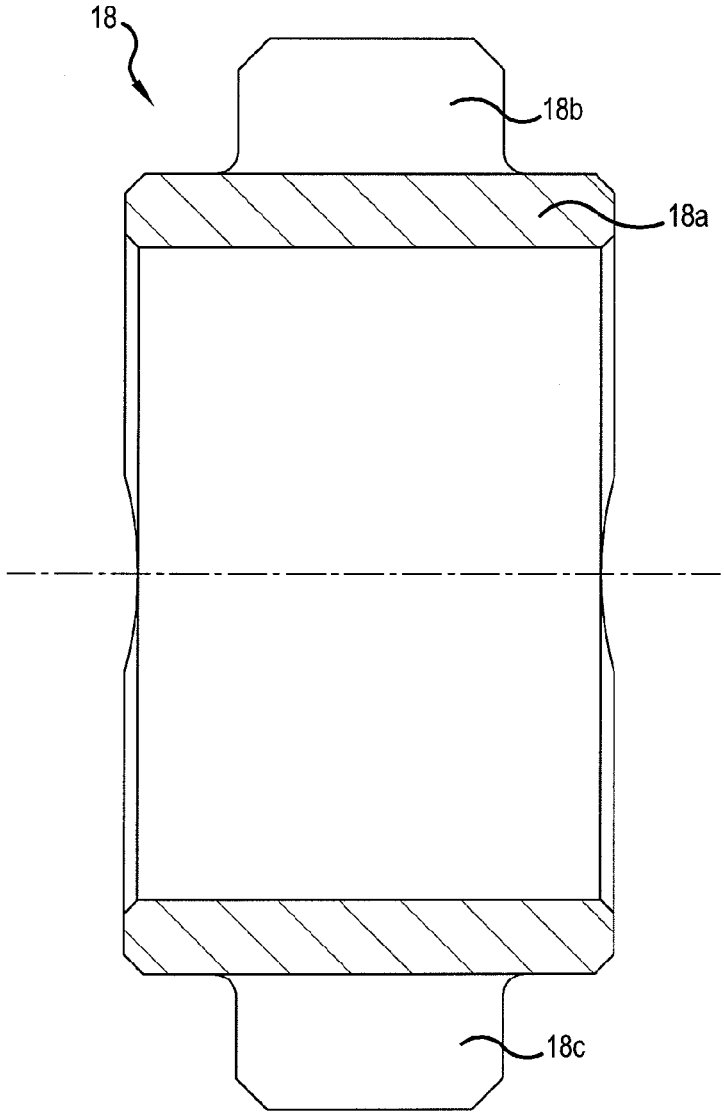
FIG. 21 is a vertical cross-sectional view of the eccentric collar 18.

FIG. 10 is an enlarged longitudinal cross-sectional view showing the vicinity of one of the eccentric collars 18 that is located farther away from the inner flange 7 in FIG. 2. FIG. 21 is a cross-sectional view of the eccentric collar 18 that appears at the center of FIG. 10. The eccentric collar 18 in FIG. 21 includes the cylindrical portion 18*a*, a drive-protrusion sandwiching portion 18*b* and a driven-protrusion sandwiching portion 18*c*. In FIG. 10, the driving protrusion 19*b* that protrudes from the driving collar 19 is held by the driving-protrusion sandwiching portion 18*b* while the driven protrusion 5*c* that protrudes from the cam lobe 5*b* of the valve-lifting cam member 5 is held by the driven-protrusion sandwiching portion 18*c*.

The configuration in the vicinity of the eccentric collar 18 that is located nearer the inner flange 7 is the same as the one shown in FIG. 10 except that the driving protrusion held by the driving-protrusion sandwiching portion 18*b* is the driving protrusion 7*a* that protrudes from the inner flange 7.

FIG. 8 is a cross-sectional view of a central portion of the eccentric collar 18 in FIG. 10 that illustrates a low-speed state. In the drawing, reference numeral O denotes the center of the camshaft 3 while reference numeral E denotes the center of the eccentric portion 12*a* of the eccentric shaft 12. The inner surface of the cylindrical portion 18*a* of the eccentric collar 18 is supported by the four sliding spacers 17 at a uniform distance from the outer circumference of the eccentric portion 12*a*. Accordingly, the center of the eccentric collar 18 is aligned with the center E of the eccentric portion 12*a* of the eccentric collar 12. The sliding spacers 17 serves as clearance-securing members to keep a constant clearance between the outer circumference of the eccentric portion 12*a* and the inner circumference of the cylindrical portion 18*a* of the eccentric collar 18. In the eccentric collar 18, the driving-protrusion sandwiching portion 18*b* and the driven-protrusion sandwiching portion 18*c* are formed integrally the eccentric collar 18 at positions that are symmetrical with respect to the center of the eccentric collar 18. The holding grooves 18*d* and 18*e* of the sandwiching portions hold the driving protrusion 19*b* and the driven protrusion 5*c* respectively. In the case of the eccentric collar 18 that is closer to the inner flange 7, what engages with the sandwiching groove 18*d* is not the driving protrusion 19*b* of the driving collar 19 but the driving protrusion 7*a* protruding from the inner flange 7.

With the above-described structure according to this embodiment, the following effects can be obtained. In the case of a low-revolution state of the internal combustion engine 1, by a controlling signal from the control unit, the eccentric portion 12*a* of the eccentric shaft 12 is turned and kept at a position farthest away from the valve top portion 21. FIG. 5 shows such a state. In addition, in accordance with a principle that is similar to the principle described in Japanese Unexamined Patent Application Laid-open Publication Sho63-1707, the timing of the starting of the opening of the valve is retarded and the timing of the closing of the valve is advanced. Accordingly, a retarded opening-start timing of the inlet valve and an advanced closing timing of the exhaust valve render the valve overlapping period shorter.

Figure 22:
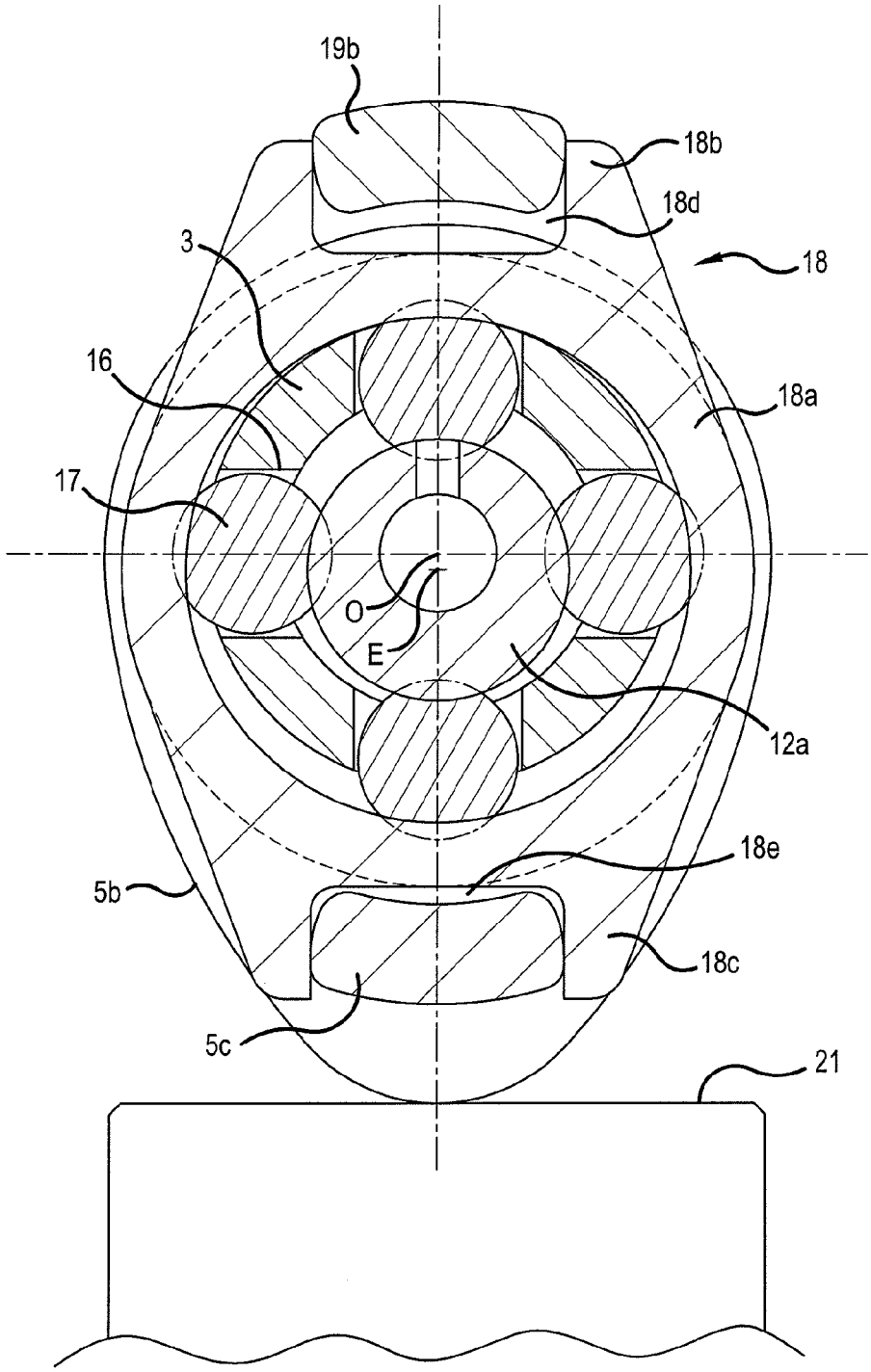
FIG. 22 is a cross-sectional view of the same position that is shown in FIG. 8 and showing a high-speed state.

FIG. 22 is a longitudinal cross-sectional view of the same position that is shown in FIG. 8, but showing a high-speed state. When the revolution of the internal combustion engine 1 is increased up to the maximum revolution, the eccentric portion 12*a* of the eccentric shaft 12 is turned and kept at a position closest to the valve top portion 21. FIG. 22 shows such a state. In addition, in accordance with a principle that is similar to the principle described above, the timing of the starting of the opening of the valve is advanced and the timing of the closing of the valve is retarded. Accordingly, an advanced opening-start timing of the inlet valve and a retarded closing timing of the exhaust valve render the valve overlapping period longer. As a result, a state suitable for the high-speed running performance is achieved.

FIGS. 17(*a*) to 17(*d*) are four-side views of the sliding spacer 17. FIG. 7(*a*) is an end-face view, FIG. 7(*b*) is a top view seen from the direction as indicated by the arrow b in FIG. 7(*a*), FIG. 7(*c*) is a side elevational view seen from the direction as indicated by the arrow c in FIG. 7(*a*), and FIG.

7(*d*) is a cross-sectional view taken along the line d-d in FIG. 7(*c*). In the longitudinal cross section, as shown in FIGS. 7(*b*) and 7(*c*), each of the two end portions of the sliding spacer 17 is cut into the shape of a circular truncated cone, and each of end faces 17*a* is thus formed in a circle with a smaller diameter. As shown in FIG. 7(*d*), a cross section across the axis of the sliding spacer 17 is made up of an arc A, another arc B, and still another arc S. The arc A forms an outer-side surface of the cross section while the arc B forms an inner-side surface thereof. The circle S forms two side portions of the cross section. While the arcs A and B are parts of concentric circles that share the same center, the arc S is a part of an outer circumferential circle 22.

Figure 18:
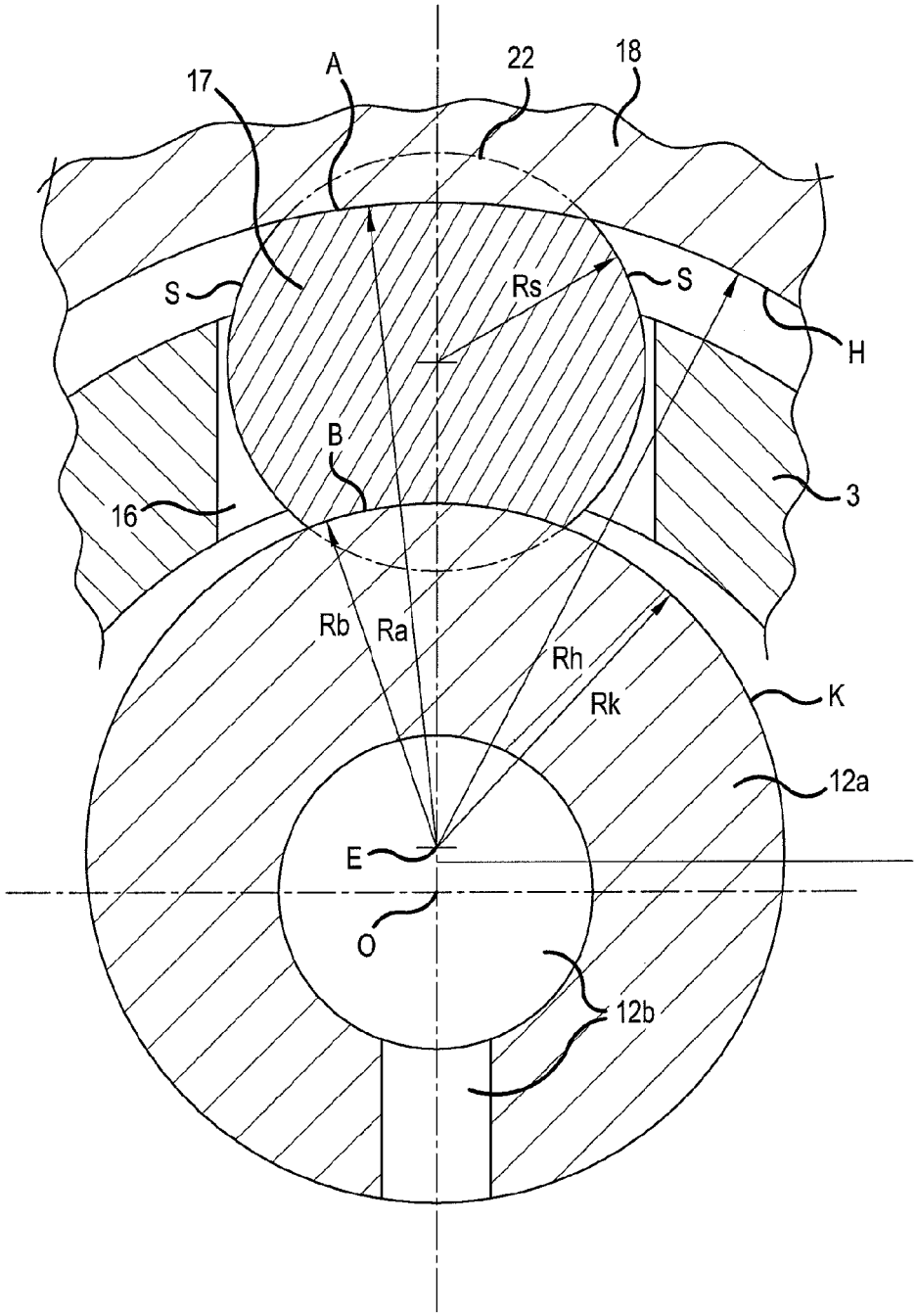
FIG. 18 is an enlarged cross-sectional view showing a sliding spacer 17 and its peripheral members according to an embodiment of the variable valve timing valve-lifting system of the present invention.

FIG. 18 is an enlarged cross-sectional view showing the sliding spacer 17 according to a first embodiment of the variable valve timing valve-lifting system of the present invention. Peripheral members related to the sliding spacer 17 are also shown in FIG. 18. Three embodiments of the present invention will be described, and differ from one another in the way of setting the curvature radius of each of the arcs that form the contour of the cross-sectional shape of the sliding spacer 17. For the following descriptions of the embodiments, definitions are given to the names and the reference numerals of the surfaces of the sliding spacer 17, to the names and the reference numerals of the surfaces of the eccentric portion 12*a* of the eccentric shaft 12, and to the names and the reference numerals of the eccentric collar 18. The definitions are as follows.

A: the sliding surface on the eccentric-collar 18 side of the sliding spacer 17.

B: the sliding surface on the eccentric-portion 12*a* side of the sliding spacer 17.

S: the side surface of the sliding spacer 17 (=the surface of the sliding spacer on a side thereof that is in contact with the retaining window 16).

H: the inner-side surface of the cylindrical portion 18*a* of the eccentric collar 18.

K: the outer-side surface of the eccentric portion 12*a* of the eccentric shaft 12.

In addition, the curvature radius or the radius of these surfaces are given the following reference numerals.

Ra: the curvature radius of the sliding surface A on the eccentric-collar 18 side of the sliding spacer 17.

Rb: the curvature radius of the sliding surface B on the eccentric-portion 12*a* side of the sliding spacer 17.

(8) Rs: the curvature radius of the side surface S of the sliding spacer 17 (=the radius of the outer circumferential circle 22).

Rh: the radius of the inner-side surface H of the cylindrical portion 18*a* of the eccentric collar 18.

Rk: the radius of the outer-side surface K of the eccentric portion 12*a* of the eccentric shaft 12.

Note that the reference numerals shown in FIG. 7(*d*) are also based on the above definitions.

In the sliding spacer 17 of the first embodiment shown in FIG. 18, the curvature radius Ra of the sliding surface A on the eccentric-collar side is made equal to the radius Rh of the inner-side surface H of the eccentric collar, that is, Ra=Rh. Meanwhile, the curvature radius Rb of the sliding surface B on the eccentric-portion side of the eccentric shaft is made equal to the radius Rk of the outer-side surface K of the eccentric portion, that is Rb=Rk. Accordingly, each of Ra, Rb, Rh, and Rk is a radius with the center being the center E of the eccentric portion 12*a*.

The sliding spacer 17 is formed as having been described above. Accordingly, the sliding surface A on the eccentric-collar 18 side of the sliding spacer 17 is in surface-contact with the inner-side surface H of the cylindrical portion 18*a* of the eccentric collar 18. In addition, the sliding surface B on the eccentric-portion 12*a* side of the sliding spacer 17 is in surface-contact with the outer-side surface K of the eccentric portion 12*a* of the eccentric shaft 12. The sliding spacer with this form can significantly lower the surface pressure on the sliding surfaces. As a consequence, the lubricant oil is supplied from the oil passage 12*b* formed in the center of the eccentric shaft 12 to the sliding surfaces in an amount that is enough to reduce the sliding resistance.

Figure 19:
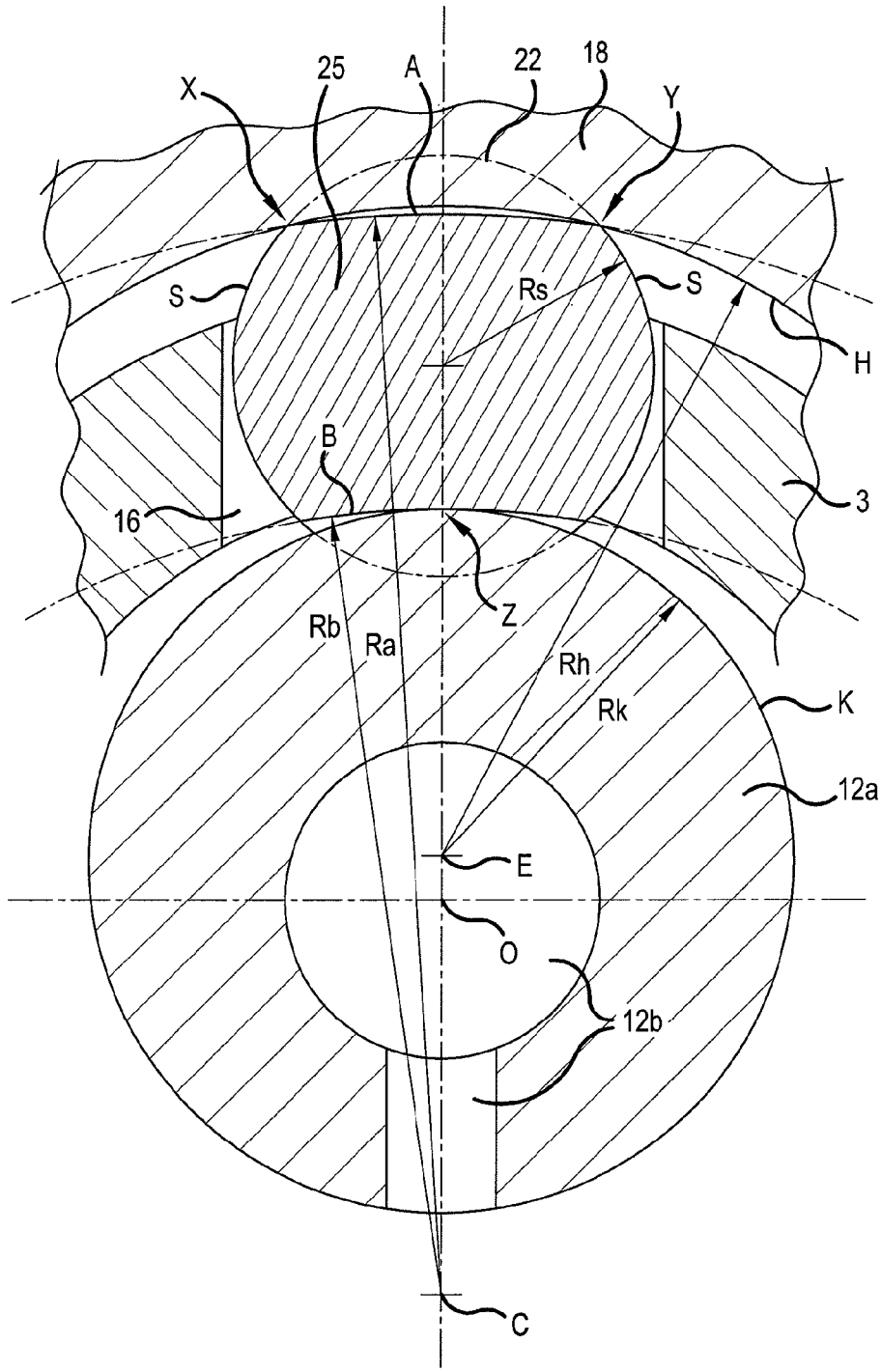
FIG. 19 is an enlarged cross-sectional view showing a sliding spacer 25 and its peripheral members according to another embodiment of the variable valve timing valve-lifting system of the present invention.

FIG. 19 is an enlarged cross-sectional view showing the sliding spacer 25 according to a second embodiment of the variable valve timing valve-lifting system of the present invention. Peripheral members related to the sliding spacer 25 are also shown in FIG. 9. The component parts of the second embodiment are the same as those in the first embodiment, except for the sliding spacer 25. In the second embodiment, the curvature radius Ra of the sliding surface A on the eccentric-collar side of the sliding spacer is made larger than the radius Rh of the inner-side surface H of the eccentric collar, that is, Ra>Rh. Meanwhile, the curvature radius Rb of the sliding surface B of the sliding spacer on the eccentric-portion side of the eccentric shaft is made larger than the radius Rk of the outer-side surface K of the eccentric portion, that is Rb>Rk. Accordingly, each of Ra and Rb is a radius with the center being the curvature center C that is far away from the sliding spacer 25.

The sliding spacer 25 is formed as having been described above. Accordingly, the sliding surface A on the eccentric-collar 18 side of the sliding spacer 25 is in line-contact, at two positions X and Y, with the inner-side surface H of the cylindrical portion 18*a* of the eccentric collar 18. In addition, the sliding surface B on the eccentric-portion 12*a* side of the sliding spacer 25 is in line-contact, at a point Z, with the outer-side surface K of the eccentric portion 12*a* of the eccentric shaft 12. Each sliding spacer slides on three points in total—two points outside and a point inside. Accordingly, the sliding surfaces can be stabilized. In addition, the rotation amount of the eccentric collar 18 relative to the sliding spacer 25 is small so that the sliding by line-contact at end portions of the sliding spacer causes no problems at all. Moreover, the rotation amount of the eccentric portion of the eccentric shaft relative to the sliding spacer 25 is large, but the angle formed by the tangential line of the eccentric portion and the tangential line of the sliding spacer is extremely small in the vicinity of each contact surface. Accordingly, the surface pressure can be lowered and favorable lubrication can be achieved.

Figure 20:
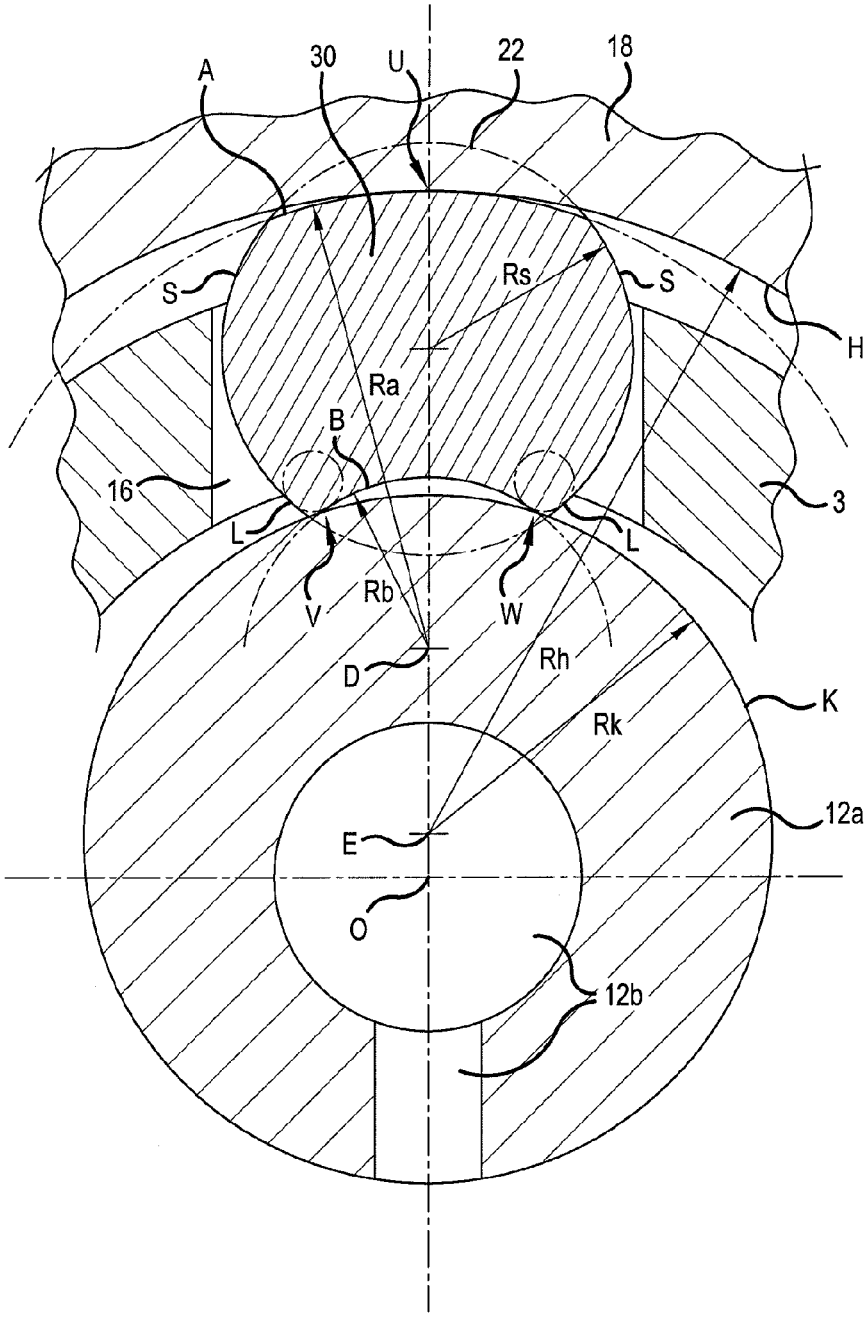
FIG. 20 is an enlarged cross-sectional view showing a sliding spacer 30 and its peripheral members according to a third embodiment of the variable valve timing valve-lifting system of the present invention.

FIG. 20 is an enlarged cross-sectional view showing the sliding spacer 30 according to a third embodiment of the variable valve timing valve-lifting system of the present invention. Peripheral members related to the sliding spacer 30 are also shown in FIG. 20. The component parts of the third embodiment are the same as those in the first embodiment, except for the sliding spacer 30. In the third embodiment, the curvature radius Ra of the sliding surface A on the eccentric-collar side of the sliding spacer is made smaller than the radius Rh of the inner-side surface H of the eccentric collar, that is, Ra<Rh. Meanwhile, the curvature radius Rb of the sliding surface B of the sliding spacer on the eccentric-portion side of the eccentric shaft is made smaller than the radius Rk of the outer-side surface K of the eccentric portion, that is Rb<Rk. Accordingly, each of Ra and Rb is a radius with the center being the curvature center D that is close to the sliding spacer 30. In addition, the sliding contact portion of the sliding spacer with the outer circumference K of the eccentric portion is formed into a curved surface L.

The sliding spacer 30 is formed as having been described above. Accordingly, each sliding spacer slides on three points in total—a point U outside and two points V and W inside. Accordingly, the sliding surfaces can be stabilized. In addition, the rotation amount of the eccentric collar relative to the sliding spacer is small, so that the eccentric collar is in contact with the sliding spacer at one point. Meanwhile, the rotation amount of the eccentric portion of the eccentric shaft relative to the sliding spacer is large, so that the eccentric portion of the eccentric shaft is in contact with the sliding spacer at two points, thereby reducing the surface pressure of the slidingly contact surface. In addition, forming the slidingly contact portion with a curved surface allows favorable lubrication to be achieved.

The embodiments that have been described in detail will have the following effects.

The sliding surfaces in and outside of the sliding spacer are formed by parts of substantially concentric circles, which is concentric when viewed in the axial direction of the camshaft. Accordingly, the sliding area between the sliding spacer and the eccentric collar as well as the sliding area between the sliding spacer and the eccentric portion of the eccentric shaft are both increased from a conventional case of using rollers. This leads to a lower surface pressure while the durability of the sliding spacer is improved.

A possible sliding spacer has such a shape as follows. When viewed in the axial direction of the camshaft, the curvature radius of the sliding surface of the sliding spacer on the eccentric-collar side is made larger than the radius of the inner-side surface of the eccentric collar. When viewed in the axial direction of the camshaft, the curvature radius of the sliding surface of the sliding spacer on the side facing the eccentric-portion of the eccentric shaft is made larger than the radius of the outer-side surface of the eccentric portion. In this case, each sliding spacer slides on three points in total—two outside and one inside. Accordingly, the sliding surfaces are stabilized. In addition, the rotation amount of the eccentric collar relative to the sliding spacer is small so that the sliding by line-contact at end portions of the sliding spacer causes no problems at all. Moreover, the rotation amount of the eccentric portion of the eccentric shaft relative to the sliding spacer is large, but the angle formed by the tangential line of the eccentric portion and the tangential line of the sliding spacer is extremely small in the vicinity of each line-contact surface. Accordingly, the surface pressure can be lowered and favorable lubrication can be achieved.

Another possible sliding spacer has such a shape as follows. When viewed in the axial direction of the camshaft, the curvature radius of the sliding surface of the sliding spacer on the eccentric-collar side is made smaller than the radius of the inner-side surface of the eccentric collar. When viewed in the axial direction of the camshaft, the curvature radius of the sliding surface of the sliding spacer on the side facing the eccentric-portion of the eccentric shaft is made smaller than the radius of the outer-side surface of the eccentric portion. In addition, the sliding contact portion of the sliding spacer with the outer circumference of the eccentric portion is formed into a curved surface. In this case, each sliding spacer slides on three points in total—a point outside and two points inside. Accordingly, the sliding surfaces can be stabilized. In addition, the rotation amount of the eccentric collar relative to the sliding spacer is small, so that the eccentric collar is in contact with the sliding spacer at one point. Meanwhile, the rotation amount of the eccentric portion of the eccentric shaft relative to the sliding spacer is large, so that the eccentric portion of the eccentric shaft is in contact with the sliding spacer at two points, thereby reducing the surface pressure of the sliding surface. In addition, forming the slidingly contact portion with a curved surface allows favorable lubrication to be achieved.

When viewed in the axial direction of the camshaft, the inner and the outer sliding surfaces of the sliding spacer are formed by parts of concentric circles. Accordingly, the sliding spacer can be fabricated by cutting a hollow pipe and then scraping a part thereof. This leads to a higher productivity.

While the inner surface of the retaining window, which surface is in contact with a side surface of the sliding spacer, is formed to be flat, the side surface of the sliding spacer, which side surface is in contact with the inner-side surface of the retaining window, is formed to be in an arc when viewed in the axial direction of the camshaft. When the eccentric portion of the eccentric shaft is located at a certain position, the sliding spacer slides within the retaining window in the radial direction. In such a situation, an improvement in operation is achieved. In addition, when the position of the eccentric portion of the eccentric shaft in the circumferential direction thereof differs, the sliding surface also differs. In such a situation, uniform sliding characteristics can be accomplished.

In the examples described in the first to the third embodiments, the sliding surface A of the sliding spacer 17 on the side facing the eccentric collar 18 and the sliding surface B on the side facing the eccentric portion 12*a* are made up of parts of concentric circles. When the productivity can be ignored, the circles do not have to be perfectly concentric circles that have perfectly the same curvature center.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A variable valve timing mechanism, in which:

a valve-lifting cam member is fitted, slidably in the circumferential direction, onto a camshaft that is driven to rotate in synchronization with a crankshaft of a four-cycle internal combustion engine;

an eccentric collar is set between a driving collar fixed on the camshaft and the valve-lifting cam member;

a linkage mechanism includes the eccentric collar, a driving projection formed in the driving collar and engaging with one of sandwiching portions of the eccentric collar, and a driven protrusion formed in the valve-lifting cam member and engaging with another one of the sandwiching portions of the eccentric collar;

with the linkage mechanism, the torque of the driving collar is transmitted to the valve-lifting cam member; and the timing of opening and closing the valve is adjusted by making the rotational phase of the valve-lifting cam member be cyclically varied relative to the camshaft by the eccentricity of the eccentric collar, the variable valve timing mechanism comprising a key provided between the camshaft and the driving collar and used to fix the driving collar onto the camshaft, wherein the key is provided so as to partially overlap the driving projection, thus enabling the key to receive a moment that acts on a base portion of the driving projection of the driving collar.

2. The variable valve timing mechanism according to claim 1, wherein the driving collar includes a cylindrical portion and the driving projection protruding from the cylindrical portion, and that the key is in a position partially overlapping the driving projection in the axial direction of the camshaft.

3. The variable valve timing mechanism according to claim 1, further comprising:

a bearing for the camshaft disposed between two flanges provided on the camshaft, and wherein the driving projection protrudes from one of the flanges to the opposite side of the flange from the side where the bearing is located.

4. The variable valve timing mechanism according to claim 1, wherein, the driving-projection sandwiching portion and the driven-projection sandwiching portion of the eccentric collar are disposed as being offset from each other in the axial direction so as to make each of the sandwiching portions get closer to the corresponding one of the protrusions that engage with the sandwiching portion.

5. The variable valve timing mechanism according to claim 1, further comprising:

clearance-securing members installed respectively in a plurality of retaining windows formed in the circumference of the camshaft, each clearance-securing member being in contact with the outer circumferential surface of an eccentric portion of an eccentric shaft fitted to a central hole of the camshaft and with the inner circumferential surface of the eccentric collar thereby securing a clearance between the two surfaces, and wherein, in the cross section of each clearance-securing member, each of the two side-end portions of the clearance-securing member, the portions being in contact with the corresponding retaining window, is formed by a part of an outer circumferential circle, and the central portion of the clearance-securing member is formed by a section that is in contact with the outer circumference of the eccentric portion and with the inner circumference of the eccentric collar.

6. A variable valve timing mechanism, comprising:

a valve-lifting cam member fitted, slidably in the circumferential direction, onto a camshaft that is driven to rotate in synchronization with a crankshaft of a four-cycle internal combustion engine;

an eccentric collar is set between a driving collar fixed on the camshaft and the valve-lifting cam member;

a linkage mechanism includes the eccentric collar, a driving projection formed in the driving collar and engaging with one of sandwiching portions of the eccentric collar, and a driven protrusion formed in the valve-lifting cam member and engaging with another one of the sandwiching portions of the eccentric collar;

torque from the driving collar is transmitted to the valve-lifting cam member;

a timing of an opening and a closing the valve is adjusted by making the rotational phase of the valve-lifting cam member be cyclically varied relative to the camshaft by the eccentricity of the eccentric collar, a key provided between the camshaft and the driving collar and used to fix the driving collar onto the camshaft, and clearance-securing members installed respectively in a plurality of retaining windows formed in the circumference of the camshaft, each clearance-securing member being in contact with the outer circumferential surface of an eccentric portion of an eccentric shaft fitted to a central hole of the camshaft and with the inner circumferential surface of the eccentric collar thereby securing a clearance between the two surfaces, and wherein, in the cross section of each clearance-securing member, each of the two side-end portions of the clearance-securing member, the portions being in contact with the corresponding retaining window, is formed by a part of an outer circumferential circle, and the central portion of the clearance-securing member is formed by a section that is in contact with the outer circumference of the eccentric portion and with the inner circumference of the eccentric collar.

7. The variable valve timing mechanism according to claim 6, wherein the driving collar includes a cylindrical portion and the driving projection protruding from the cylindrical portion, and the key is in a position partially overlapping the driving projection in the axial direction of the camshaft.

8. The variable valve timing mechanism according to claim 6, further comprising:

a bearing for the camshaft disposed between two flanges provided on the camshaft, and wherein the driving projection protrudes from one of the flanges to the opposite side of the flange from the side where the bearing is located.

9. The variable valve timing mechanism according to claim 6, wherein, the driving-projection sandwiching portion and the driven-projection sandwiching portion of the eccentric collar are disposed as being offset from each other in the axial direction so as to make each of the sandwiching portions get closer to the corresponding one of the protrusions that engage with the sandwiching portion.

10. A variable valve timing valve-lifting system comprising:

a camshaft having a central hole and rotating in synchronization with rotations of a crankshaft;

an eccentric shaft having an eccentric portion and being inserted into the central hole of the camshaft;

a driving collar fixed onto the camshaft and rotating together with the camshaft;

an eccentric collar rotating, in response to the rotation of the driving collar, on a rotating center that is offset from a rotating center of the camshaft;

the eccentric portion of the eccentric shaft, the eccentric portion positioned on the inner circumferential side of the eccentric collar and changing the position of the rotating center of the eccentric collar when the eccentric shaft moves rotationally;

a valve-lifting cam member rotating in response to the rotation of the eccentric collar;

a plurality of retaining windows formed in a part, located between the eccentric collar and the eccentric portion, of the camshaft, and formed so as to allow communication between an eccentric-collar side and an eccentric-portion side to be accomplished therethrough; and clearance-securing members disposed respectively in the retaining windows, each clearance-securing member being in contact both with the eccentric collar and with the eccentric portion, thereby securing clearance between the eccentric collar and the eccentric portion; and said clearance-securing members are sliding spacers, with each of the sliding spacers having an inner-side and an outer-side contact surfaces, the contact surfaces being formed by curved lines that are considered, substantially, to be parts of concentric circles when viewed in the axial direction of the camshaft, and the sliding spacers slide both on the eccentric collar and on the eccentric portion.

11. The variable valve timing valve-lifting system according to claim 10, wherein when viewed in the axial direction of the camshaft, the curvature radius of a sliding surface of the sliding spacer on the eccentric-collar side is larger than the radius of an inner-side surface of the eccentric collar, and when viewed in the axial direction of the camshaft, the curvature radius of the sliding surface of the sliding spacer on a side facing the eccentric-portion of the eccentric shaft is larger than the radius of an outer-side surface of the eccentric portion.

12. The variable valve timing valve-lifting system according to claim 10, wherein when viewed in the axial direction of the camshaft, the curvature radius of a sliding surface of the sliding spacer on the eccentric-collar side is smaller than the radius of an inner-side surface of the eccentric collar;

when viewed in the axial direction of the camshaft, the curvature radius of the sliding surface of the sliding spacer on a side facing the eccentric portion of the eccentric shaft is smaller than the radius of an outer-side surface of the eccentric portion; and a curved surface is formed in the edge portion of a sliding contact portion of the sliding spacer with an outer circumference of the eccentric portion.

13. The variable valve timing valve-lifting system according to claim 11, wherein when viewed in the axial direction of the camshaft, the sliding surface of the sliding spacer on the eccentric-collar side and the sliding surface of the sliding spacer on the eccentric-portion side are formed by parts of concentric circles.

14. The variable valve timing valve-lifting system according to claim 12, wherein when viewed in the axial direction of the camshaft, the sliding surface of the sliding spacer on the eccentric-collar side and the sliding surface of the sliding spacer on the eccentric-portion side are formed by parts of concentric circles.

15. The variable valve timing valve-lifting system according to claim 10, wherein an inner-side surface of the retaining window, which surface is in contact with a side surface of the sliding spacer, is formed to be flat; and the side surface of the sliding spacer, which side surface is in contact with the inner-side surface of the retaining window, is formed to be in an arc when viewed in the axial direction of the camshaft.

16. The variable valve timing valve-lifting system according to claim 11, wherein an inner-side surface of the retaining window, which surface is in contact with a side surface of the sliding spacer, is formed to be flat; and the side surface of the sliding spacer, which side surface is in contact with the inner-side surface of the retaining window, is formed to be in an arc when viewed in the axial direction of the camshaft.

17. The variable valve timing valve-lifting system according to claim 12, wherein an inner-side surface of the retaining window, which surface is in contact with a side surface of the sliding spacer, is formed to be flat; and the side surface of the sliding spacer, which side surface is in contact with the inner-side surface of the retaining window, is formed to be in an arc when viewed in the axial direction of the camshaft.

18. The variable valve timing valve-lifting system according to claim 13, wherein an inner-side surface of the retaining window, which surface is in contact with a side surface of the sliding spacer, is formed to be flat; and the side surface of the sliding spacer, which side surface is in contact with the inner-side surface of the retaining window, is formed to be in an arc when viewed in the axial direction of the camshaft.

19. The variable valve timing valve-lifting system according to claim 14, wherein an inner-side surface of the retaining window, which surface is in contact with a side surface of the sliding spacer, is formed to be flat; and the side surface of the sliding spacer, which side surface is in contact with the inner-side surface of the retaining window, is formed to be in an arc when viewed in the axial direction of the camshaft.

* * * * *